US011427427B2

(12) United States Patent
Ishibashi et al.

(10) Patent No.: US 11,427,427 B2
(45) Date of Patent: Aug. 30, 2022

(54) SHEET STACKING APPARATUS, SHEET PROCESSING APPARATUS, AND IMAGE FORMING SYSTEM

(71) Applicant: CANON KABUSHIKI KAISHA, Tokyo (JP)

(72) Inventors: Haruki Ishibashi, Shizuoka (JP); Kazuhiko Aono, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/208,980

(22) Filed: Mar. 22, 2021

(65) Prior Publication Data

US 2021/0309480 A1 Oct. 7, 2021

(30) Foreign Application Priority Data

Apr. 2, 2020 (JP) ..... JP2020-066671

(51) Int. Cl.
*B65H 31/10* (2006.01)
*B65H 31/26* (2006.01)
*G03G 15/00* (2006.01)

(52) U.S. Cl.
CPC ..... *B65H 31/10* (2013.01); *B65H 31/26* (2013.01); *G03G 15/6529* (2013.01); *B65H 2301/362* (2013.01); *B65H 2301/363* (2013.01); *B65H 2801/27* (2013.01)

(58) Field of Classification Search
None
See application file for complete search history.

(56) References Cited

U.S. PATENT DOCUMENTS 6,712,349 B2 * 3/2004 Watanabe ..... B65H 15/004 270/37
7,762,541 B2 * 7/2010 Harashina ..... B42C 1/125 270/58.13
7,950,652 B2 * 5/2011 Terao ..... B65H 31/26 271/189

(Continued)

FOREIGN PATENT DOCUMENTS

JP 2001233531 A 8/2001
JP 2002308507 A 10/2002
JP 2008094612 A 4/2008

(Continued)

*Primary Examiner* — Leslie A Nicholson, III
(74) *Attorney, Agent, or Firm* — Canon U.S.A., Inc. I.P. Division

(57) ABSTRACT

A sheet stacking apparatus includes a discharge unit, a stacking portion on which discharged sheets are stacked, a lifting unit, and first and second abutting portions. The lifting unit lifts and lowers the stacking portion. The first abutting portion abuts a trailing end of the stacked sheets in a sheet discharge direction. The first abutting portion does not move in an up-down direction. The second abutting portion abuts the stacked sheets trailing end. The first abutting portion supports the second abutting portion such that the second abutting portion is movable in the up-down direction. If the stacking portion is lowered from a first to a second position below the first position, the second abutting portion does not move in accordance with the stacking portion. If the stacking portion is further lowered beyond the second position, the second abutting portion moves in accordance with the stacking portion.

17 Claims, 9 Drawing Sheets

(56) References Cited

U.S. PATENT DOCUMENTS

| | | | | |
|---|---|---|---|---|
| 8,047,523 | B2 * | 11/2011 | Terao | B65H 31/10<br>270/58.11 |
| 2008/0315504 | A1 | 12/2008 | Terao | |

FOREIGN PATENT DOCUMENTS

| | | | |
|---|---|---|---|
| JP | 2009249110 | A | 10/2009 |
| JP | 2010111511 | A | 5/2010 |
| JP | 2014218353 | A | 11/2014 |

* cited by examiner

SHEET STACKING APPARATUS, SHEET PROCESSING APPARATUS, AND IMAGE FORMING SYSTEM

BACKGROUND

Field

The present disclosure relates to a sheet stacking apparatus that discharges a sheet, a sheet processing apparatus that process a sheet, and an image forming system that forms an image on a sheet.

Description of the Related Art

In a sheet stacking apparatus in which sheets on which images have been formed are stacked in an image forming apparatus such as a copier or a printer, a stacking portion such as a tray that is lifted and lowered with sheets supported thereon is used. A sheet abutting portion that abuts the trailing end of the sheets discharged onto the stacking portion to regulate the sheet position is provided in a member positioned upstream of the stacking portion in a sheet discharge direction such as the casing of the image forming apparatus.

When the stacking portion supporting sheets is lifted or lowered, there is a possibility that problems such as noises and damage to the trailing end of the sheets arise as a result of the trailing end of the sheets rubbing the sheet abutting portion. Japanese Patent Laid-Open No. 2002-308507 discloses a configuration in which a belt member capable of abutting the trailing end of a sheet is disposed upstream of a discharge tray in a sheet discharge direction is provided. According to this document, as a result of the friction between the belt member and the sheet on the discharge tray, the belt member rotates in accordance with the lifting and lowering of the discharge tray.

In the configuration disclosed in Japanese Patent Laid-Open No. 2002-308507, the belt member moves in accordance with the lifting and lowering of the discharge tray irrespective of the position of the discharge tray.

SUMMARY

The present disclosure provides a sheet stacking apparatus and an image forming apparatus that can suppress occurrence of an issue caused by rubbing of a sheet.

According to an aspect of the present disclosure, a sheet stacking apparatus includes a discharge unit configured to discharge a sheet, a stacking portion on which sheets discharged by the discharge unit are stacked, a lifting unit configured to lift and lower the stacking portion, a first abutting portion configured to abut a trailing end of the sheets stacked on the stacking portion in a sheet discharge direction of the discharge unit, wherein the first abutting portion is configured not to move in an up-down direction, and a second abutting portion configured to abut the trailing end of the sheets stacked on the stacking portion, wherein the first abutting portion supports the second abutting portion such that the second abutting portion is movable in the up-down direction, wherein, in a case where the stacking portion is lowered from a first position to a second position below the first position, the second abutting portion is configured not to move in accordance with the stacking portion, and wherein, in a case where the stacking portion is further lowered beyond the second position, the second abutting portion is configured to move in accordance with the stacking portion.

Further features of the present disclosure will become apparent from the following description of exemplary embodiments with reference to the attached drawings.

DESCRIPTION OF THE EMBODIMENTS

Exemplary embodiments of the present disclosure will be described below with reference to drawings.

In the description below, a horizontal component of a sheet discharge direction in which a sheet stacking apparatus serving as a sheet discharge apparatus discharges a sheet will be referred to as a Y direction, a sheet width direction of the sheet intersecting with the Y direction will be referred to as an X direction, and the vertical direction will be referred to as a Z direction. The X direction serves as a main scanning direction in image formation. The X direction, the Y direction, and the Z direction are preferably perpendicular to one another.

First Embodiment

Figure 1:
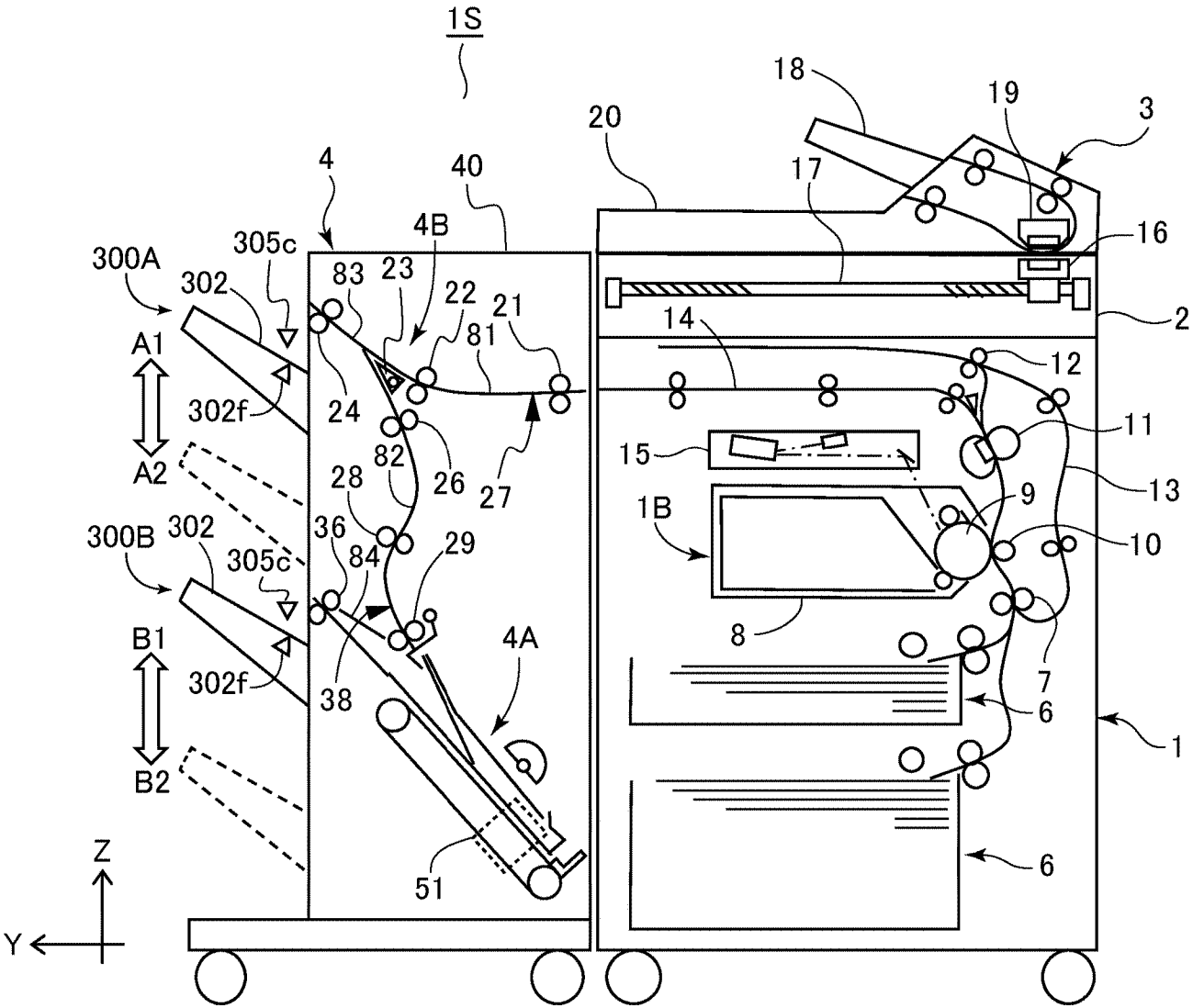
FIG. 1 is a schematic view of an image forming system according to a first embodiment.

FIG. 1 is a schematic view of an image forming system 1S according to a first embodiment. The image forming system 1S of the present embodiment includes an image forming apparatus 1, an image reading apparatus 2, a document feeding apparatus 3, and a post-processing apparatus 4. The image forming system 1S forms an image on a sheet serving as a recording material, and outputs the sheet after processing the sheet by the post-processing apparatus 4 if necessary. Hereinafter, simple description of the operation of each apparatus will be given, and then the post-processing apparatus 4 will be described in detail.

The document feeding apparatus 3 conveys a document placed on a document tray 18 to image reading portions 16 and 19. The image reading portions 16 and 19 are image sensors that read image information from respective document surfaces, and both surfaces of a document are read in one time of conveyance of the document. The document whose image information has been read is discharged onto a document discharge portion 20. In addition, the image reading apparatus 2 can read image information from a still document set on a platen glass, by reciprocating the image reading portion 16 by a driving device 17. Examples of the still document include documents such as booklet documents for which the document feeding apparatus 3 cannot be used.

The image forming apparatus 1 is an electrophotographic apparatus including an image forming portion 1B of a direct transfer system. The image forming portion 1B includes a cartridge 8 including a photosensitive drum 9, and a laser scanner unit 15 disposed above the cartridge 8. In the case of performing an image forming operation, the surface of the rotating photosensitive drum 9 is charged, and the laser scanner unit 15 draws an electrostatic latent image on the surface of the photosensitive drum 9 by exposing the photosensitive drum 9 on the basis of image information. The electrostatic latent image born on the photosensitive drum 9 is developed into a toner image by charged toner particles, and the toner image is conveyed to a transfer portion where the photosensitive drum 9 and a transfer roller 10 face each other. The controller of the image forming apparatus 1, which is a printer controller that will be described later, executes an image forming operation by the image forming portion 1B on the basis of image information read by the image reading portions 16 and 19 or image information received from an external computer via a network.

The image forming apparatus 1 includes a plurality of feeding apparatuses 6 that feed sheets serving as recording materials one by one at predetermined intervals. A sheet fed from a feeding apparatus 6 is conveyed to the transfer portion after the skew thereof is corrected by registration rollers 7, and in the transfer portion, the toner image born on the photosensitive drum 9 is transferred thereto. A fixing unit 11 is disposed downstream of the transfer portion in a sheet conveyance direction. The fixing unit 11 includes a rotary member pair that nips and conveys the sheet, and a heat generating member such as a halogen lamp for heating the toner image, and performs image fixing processing on the toner image on the sheet by heating and pressurizing the toner image.

In the case of discharging the sheet having undergone image formation to the outside of the image forming apparatus 1, the sheet having passed through the fixing unit 11 is conveyed to the post-processing apparatus 4 via a horizontal conveyance portion 14. In the case of a sheet image formation on a first surface of which is finished in duplex printing, the sheet having passed through the fixing unit 11 is passed onto reverse conveyance rollers 12, switched back and conveyed by the reverse conveyance rollers 12, and conveyed to the registration rollers 7 again via a reconveyance portion 13. Then, an image is formed on a second surface of the sheet as a result of the sheet passing through the transfer portion and the fixing unit 11 again, and then the sheet is conveyed to the post-processing apparatus 4 via the horizontal conveyance portion 14.

The image forming portion 1B described above is an example of an image forming unit that forms an image on a sheet, and an electrophotographic unit of an intermediate transfer system that transfers a toner image formed on a photosensitive member onto a sheet via an intermediate transfer member may be used therefor. In addition, a printing unit of an inkjet system or an offset printing system may be used as the image forming unit.

Post-Processing Apparatus

The post-processing apparatus 4 includes a binding processing portion 4A that performs a binding process on sheets received from the image forming apparatus 1, and discharges the sheets as a sheet bundle. In addition, the post-processing apparatus 4 is also capable of simply discharging a sheet received from the image forming apparatus 1 without performing a binding process thereon. To be noted, the binding processing portion 4A is an example of a processing unit that performs a process on a sheet, and a processing portion that performs a punching process, a processing portion that performs a folding process, or the like may be provided in place of or in addition to the binding processing portion 4A.

The post-processing apparatus 4 includes an entry path 81, an in-body discharge path 82, a first discharge path 83, and a second discharge path 84 as conveyance paths for conveying a sheet, and an upper discharge portion 300A and a lower discharge portion 300B are provided as discharge destinations onto which a sheet is discharged. The entry path 81 serves as a conveyance path through which a sheet is received from the outside of the post-processing apparatus 4 and conveyed. The first discharge path 83 serves as a first conveyance path through which the sheet received from the image forming apparatus 1 is discharged onto the upper discharge portion 300A. The in-body discharge path 82 serves as a second conveyance path which is branched from the first conveyance path and through which a sheet reversed and conveyed in the first conveyance path is conveyed toward the binding processing portion 4A. The second discharge path 84 serves as a third conveyance path through which the sheet conveyed to the binding processing portion 4A is discharged onto the lower discharge portion 300B.

In the entry path 81, inlet rollers 21, pre-buffer rollers 22, an entrance sensor 27, and a lateral position detection sensor are disposed. In the first discharge path 83, discharging/reversing rollers 24 serving as a reverse conveyance unit are disposed. In the in-body discharge path 82, in-body discharge rollers 26, intermediate conveyance rollers 28, kick-out rollers 29, and a pre-intermediate supporting sensor 38 are disposed. Each roller described above functions as a conveyance unit that conveys a sheet. In the second discharge path 84, bundle discharge rollers 36 are disposed. The entrance sensor 27 and the pre-intermediate supporting sensor 38 each serve as an example of a sheet detection portion that detects passage of a sheet at a predetermined detection position in a conveyance path in a sheet processing apparatus. As the entrance sensor 27 and the pre-intermediate supporting sensor 38, optical sensors that detect presence/absence of a sheet at the detection position by using light as will be described later can be used.

A sheet conveyance path in the post-processing apparatus 4 will be described below. To be noted, a buffering operation by a buffering portion 4B including the discharging/reversing rollers 24, and the detailed configuration and operation of the binding processing portion 4A will be described later.

The sheet discharged from the horizontal conveyance portion 14 of the image forming apparatus 1 is received by the inlet rollers 21, and is conveyed toward the pre-buffer rollers 22 through the entry path 81. The entrance sensor 27 detects the sheet at a detection position between the inlet rollers 21 and the pre-buffer rollers 22. In addition, the lateral position detection sensor detects the position of the sheet in the sheet width direction (i.e., in the X direction) at a position between the detection position of the entrance sensor 27 and the pre-buffer rollers 22. In the description below, this position will be referred to as a lateral position of the sheet. The pre-buffer rollers 22 convey the sheet received from the inlet rollers 21 toward the first discharge path 83.

To be noted, at a predetermined timing after the entrance sensor 27 has detected passage of a trailing end of the sheet, the sheet conveyance speed of the pre-buffer rollers 22 is increased to a speed higher than the conveyance speed in the horizontal conveyance portion 14. In addition, the sheet conveyance speed of the inlet rollers 21 may be set to be higher than that in the horizontal conveyance portion 14, and the conveyance speed may be increased by the inlet rollers 21 upstream of the pre-buffer rollers 22. In this case, it is preferable that a one-way clutch is disposed between a conveyance roller of the horizontal conveyance portion 14 and a motor that drives the conveyance roller such that the conveyance roller idles when the sheet is pulled by the inlet rollers 21.

In the case where the discharge destination of the sheet is the upper discharge portion 300A, the discharging/reversing rollers 24 discharge the sheet received from the pre-buffer rollers 22 onto the discharge portion 300A serving as a first discharge unit. In this case, the discharging/reversing rollers 24 decelerate to a predetermined discharge speed at a predetermined timing after the trailing end of the sheet has passed through the pre-buffer rollers 22.

In the case where the discharge destination of the sheet is the lower discharge portion 300B, the discharging/reversing rollers 24 switch back and convey the sheet received from the pre-buffer rollers 22 toward the in-body discharge path 82. A non-return flap 23 is provided at a branching portion upstream of the discharging/reversing rollers 24 in the sheet discharge direction of the discharging/reversing rollers 24 where the entry path 81 and the in-body discharge path 82 branch from the first discharge path 83. The non-return flap 23 has a function of suppressing backward movement of the sheet switched back by the discharging/reversing rollers 24 into the entry path 81.

The in-body discharge rollers 26, the intermediate conveyance rollers 28, and the kick-out rollers 29 disposed in the in-body discharge path 82 convey the sheet received from the discharging/reversing rollers 24 toward the binding processing portion 4A while passing the sheet onto one another. The pre-intermediate supporting sensor 38 detects the sheet at a position between the intermediate conveyance rollers 28 and the kick-out rollers 29.

The binding processing portion 4A includes a stapler 51 serving as a binding unit of the present embodiment, and staples a predetermined position of the sheet bundle by the stapler 51 after aligning a plurality of sheets received from the in-body discharge path 82. The sheet bundle stapled by the binding processing portion 4A is passed onto the bundle discharge rollers 36 through the second discharge path 84 serving as a third conveyance path, and is discharged onto the discharge portion 300B by the bundle discharge rollers 36 serving as a second discharge unit.

The upper and lower discharge portions 300A and 300B described above are each an example of a sheet stacking apparatus by which sheets are discharged and stacked. To be noted, the discharge portions 300A and 300B each have a function of performing a discharge method of changing a discharge position of a sheet among a plurality of positions in the sheet width direction each time a predetermined number of sheets are discharged. This discharge method is also referred to as jog discharge.

The discharge portions 300A and 300B are each provided with a tray 302 serving as a stacking portion configured to support sheets thereon. The trays 302 are each capable of moving up and down, that is, capable of being lifted and lowered, with respect to the apparatus body 40 of the post-processing apparatus 4 by a lifting mechanism 330 that will be described later. The tray 302 of the present embodiment moves up and down substantially in the vertical direction with respect to the apparatus body 40 as viewed from the front side of the image forming system 1S in FIG. 1. To be noted, the apparatus body 40 is a casing that includes a frame member and an exterior member of the post-processing apparatus 4, accommodates the binding processing portion 4A and a conveyance path, and movably supports the trays 302.

The discharge portions 300A and 300B are each provided with a sheet surface detection sensor 305*c* serving as a detection portion for detecting a sheet stacking height, which is the upper surface position of sheets stacked on the tray 302. The sheet surface detection sensor 305*c* is configured such that the output signal thereof changes in accordance with the presence or absence of a sheet at a predetermined detection height. For example, a photoelectric sensor of a transmission type utilizing laser light passing through a space above the tray 302 in the X direction at a detection height can be used as the sheet surface detection sensor 305*c*. In addition, the discharge portions 300A and 300B are each provided with a sheet presence/absence sensor 302*f* for detecting the presence or absence of a sheet on the tray 302. The sheet presence/absence sensor 302*f* is configured such that the output signal thereof changes in accordance with whether or not a sheet is present at a detection position on the tray 302. For example, as the sheet presence/absence sensor 302*f*, a flag member illustrated in FIG. 2A disposed to project from the tray 302 and a photo interrupter that detects swing of the flag member caused by being pressed by a sheet can be used.

A controller of the post-processing apparatus 4 controls the lifting mechanism 330, which will be described later, on the basis of the detection results of the sheet surface detection sensors 305*c* and the sheet presence/absence sensors 302*f*, and thus controls the height of the trays 302 of the discharge portions 300A and 300B. Specifically, in the case where the detection result of a sheet presence/absence sensor 302*f* indicates that no sheet is present on a tray 302, the tray 302 is maintained at a predetermined home position. When sheets are discharged by the discharging/reversing rollers 24 or the bundle discharge rollers 36 and stacked on the tray 302, the stacking height of sheets on the tray 302 increases. Then, each time the detection result of the sheet surface detection sensor 305*c* indicates that a sheet is present at a predetermined detection height, the lifting mechanism 330 is driven to lower the tray 302 by a predetermined amount in an A2 direction or a B2 direction.

In the case where the detection result of the sheet surface detection sensor 305*c* indicates that the sheets have been removed from the tray 302, the lifting mechanism 330 is driven to lift the tray 302 in an A1 direction or a B1 direction to return to the home position. In addition, in the case where it is determined that the tray 302 is full, for example, in the case where the sheet surface detection sensor 305*c* has detected a sheet in a state in which the tray 302 is at the lowest position within the lifting/lowering range thereof, the controller determines that it is impossible to discharge a sheet and stops the image forming operation.

According to such lifting/lowering control, in the discharge portions 300A and 300B, usually a distance in the Z direction in which a sheet discharged from the discharging/reversing rollers 24 or the bundle discharge rollers 36 falls onto the upper surface of a sheet on the tray 302 falls within a certain range. This suppresses falling of a sheet from the tray 302 and extreme misalignment of sheets, and thus contributes to maintaining a stable stacking state even in the case where the amount of stacked sheets is large.

A discharge portion 300 serving as a sheet stacking apparatus according to the first embodiment will be described with reference to FIGS. 2A to 5B. For example, the configuration of the discharge portion 300 that will be described below is suitably used as the upper discharge portion 300A in the post-processing apparatus 4 described above. In addition, the discharge portion 300 is also usable as the lower discharge portion 300B in the post-processing apparatus 4.

Figure 2B:
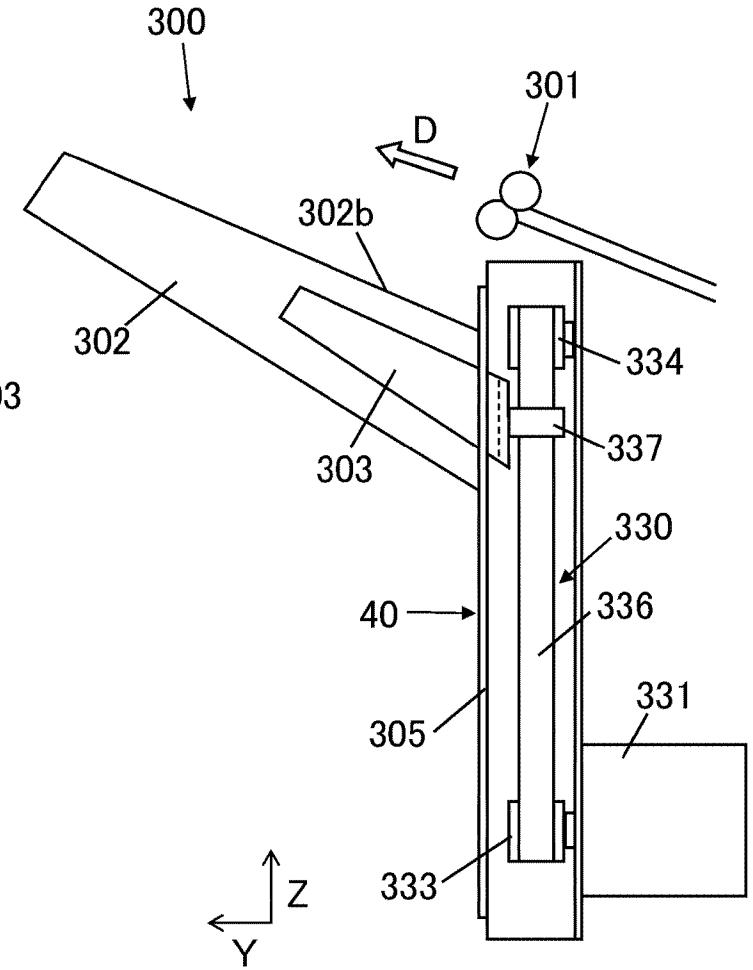
FIG. 2B is a schematic view of the sheet discharge portion according to the first embodiment.
Figure 2A:
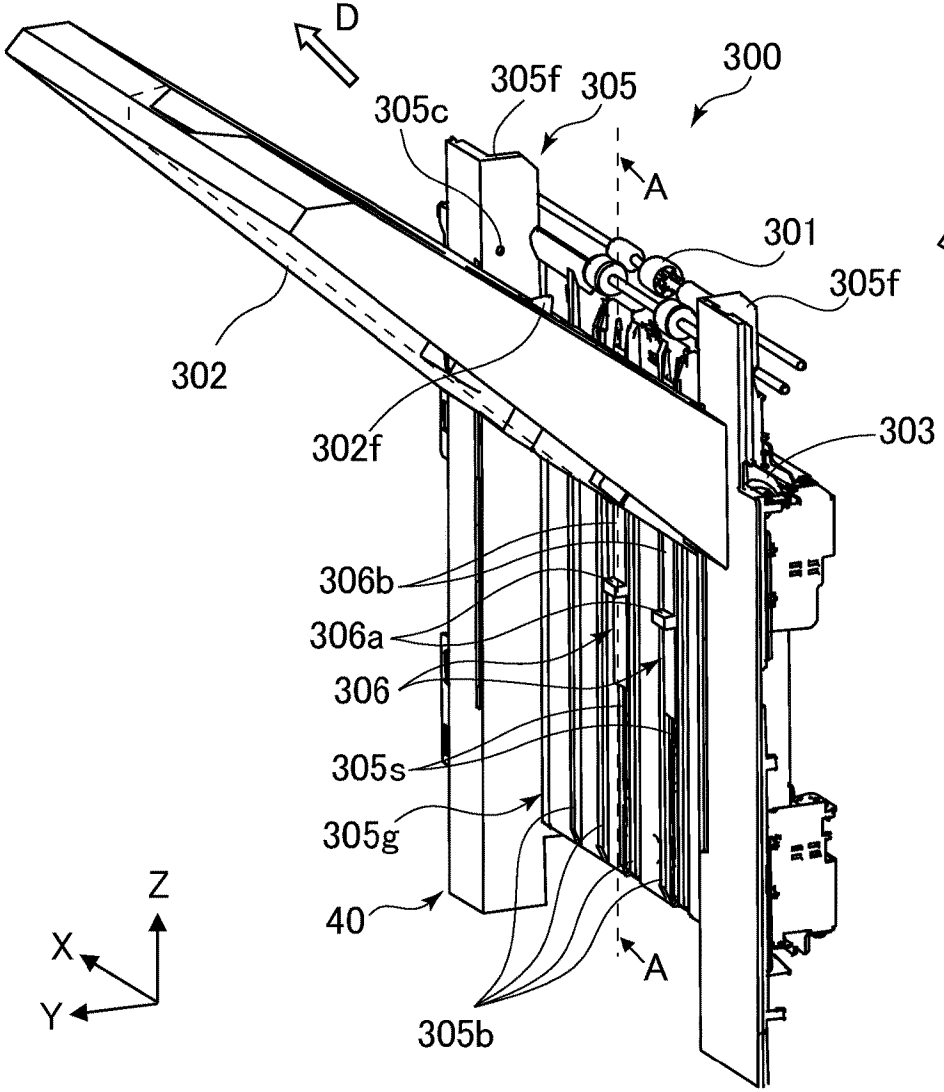
FIG. 2A is a perspective view of a sheet discharge portion according to the first embodiment.
Figure 3B:
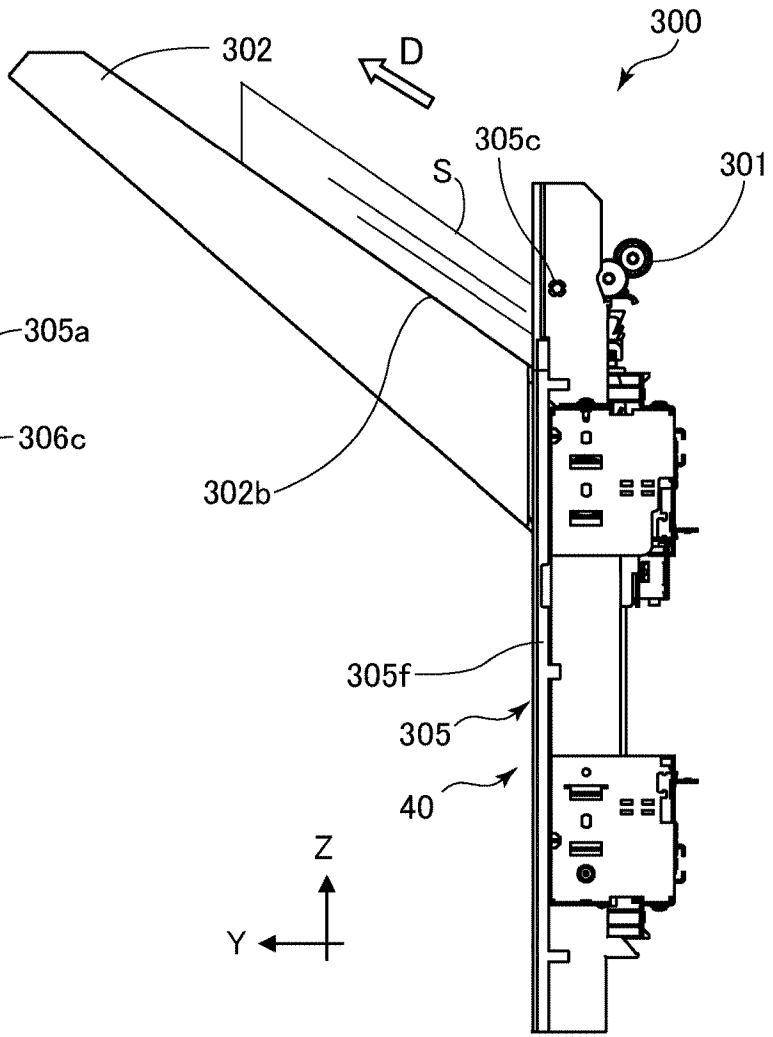
FIG. 3B is a side view of the sheet discharge portion according to the first embodiment.
Figure 3A:
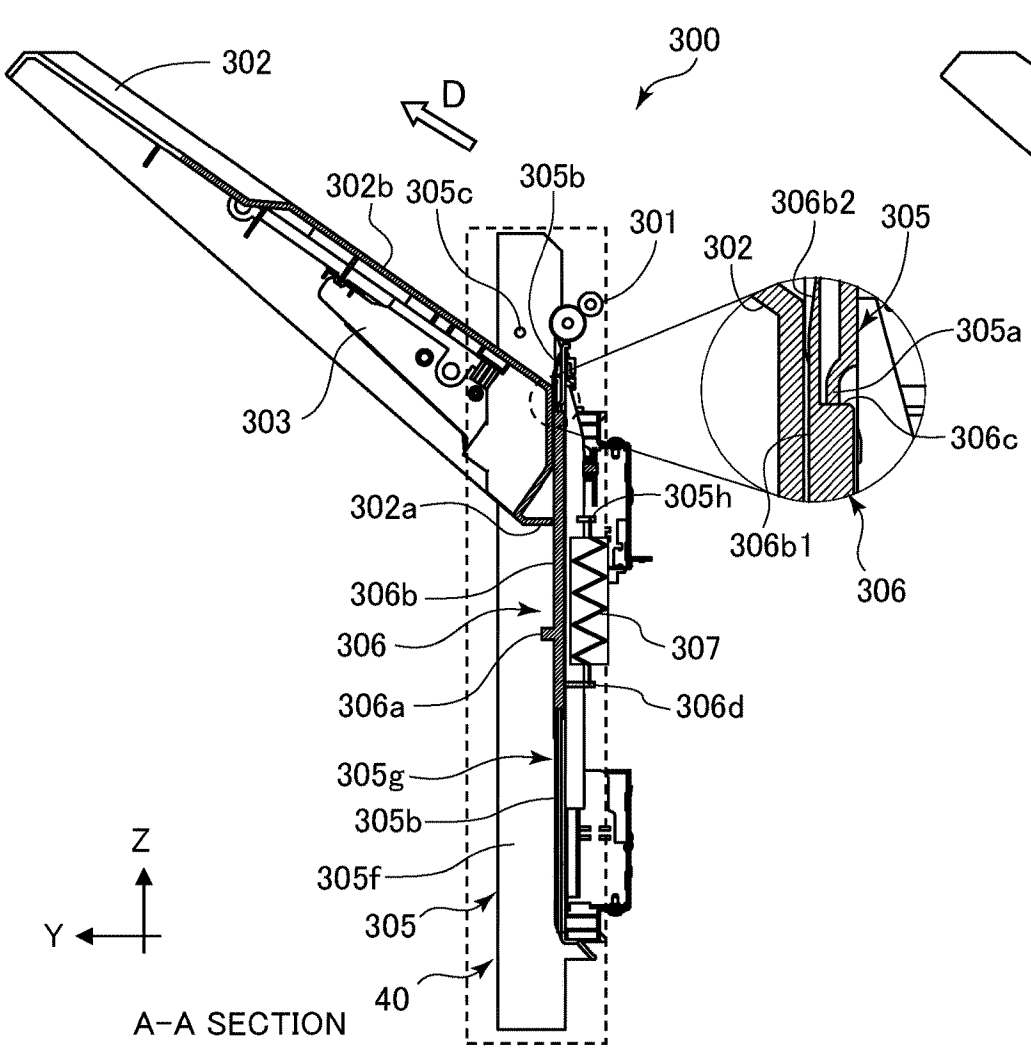
FIG. 3A is a section view of the sheet discharge portion according to the first embodiment.

FIG. 2A is a perspective view of the discharge portion 300, and FIG. 2B is a schematic view of the lifting mechanism 330 of the tray 302. FIG. 3A is a section view of the discharge portion 300 taken along a Y-Z plane at the position of a line A-A of FIG. 2A, which sections one of slide walls 306 that will be described later. FIG. 3B is a side view of the discharge portion 300 as viewed in the X direction.

As illustrated in FIGS. 2A and 2B, the discharge portion 300 includes a discharge roller pair 301, the tray 302, and the lifting mechanism 330. In addition, the discharge portion 300 includes a stacking wall 305*g* provided on a side wall 305 of the apparatus body 40 on one side in the Y direction (i.e., downstream side in a sheet discharge direction D), and slide walls 306 movable with respect to the stacking wall 305*g*. The discharge roller pair 301 is an example of a discharge unit that discharges sheets conveyed through the conveyance path in the apparatus body 40. Examples of the sheets include a sheet bundle formed by a binding process or the like. To be noted, the discharge roller pair 301 may be used as the discharging/reversing rollers 24 or as the bundle discharge rollers 36 of FIG. 1. The tray 302 is an example of a stacking portion on which sheets discharged by the discharge unit are stacked.

In the present embodiment, a direction in which the discharge roller pair 301 nips a sheet and delivers out the sheet is referred to as the sheet discharge direction D. In the present embodiment, the sheet discharge direction D is inclined upward in the Z direction toward a first side in the Y direction. In addition, the lifting/lowering direction of the tray 302 with respect to the apparatus body 40 is a direction intersecting with the horizontal plane, and is substantially the same as the Z direction in the present embodiment.

The tray 302 has a supporting surface 302*b* serving as a supporting portion that supports a sheet. At least part of the supporting surface 302*b* is inclined upward in the Z direction toward the far side in the Y direction with respect to the apparatus body 40, that is, to the left in FIG. 2B. Due to the inclination of the supporting surface 302*b*, a sheet having been discharged from the discharge roller pair 301 and having fallen onto the tray 302 moves toward the side wall 305 of the apparatus body 40, and thus alignment of sheets on the tray 302 is improved. In addition, due to the inclination of the supporting surface 302*b*, the normal force that the sheets stacked on the tray 302 receive from the supporting surface 302*b* includes a Y-direction component toward the side wall 305.

The tray 302 is coupled to the lifting mechanism 330 via a stay 303. The lifting mechanism 330 includes a lifting motor 331 serving as a drive source, and a belt drive transmission portion including a driving pulley 333, a driven pulley 334, and a lifting belt 336. The lifting belt 336 is stretched over the driving pulley 333 and the driven pulley 334 that are arranged with an interval therebetween in the Z direction. The driving pulley 333 and the driven pulley 334 are rotatably supported by the frame member of the apparatus body 40. The driving pulley 333 is driven to rotate by the lifting motor 331, and the driven pulley 334 rotates in accordance with the rotation of the lifting belt 336. In addition, the stay 303 is fixed to the lifting belt 336 via a fixing member 337.

As a result of the lifting mechanism 330 described above, the tray 302 is lifted and lowered in accordance with the rotation of the lifting motor 331. The movement direction of the tray 302, that is, whether the tray 302 is lifted or lowered is determined in accordance with the rotation direction of the lifting motor 331, the movement amount of the tray 302 is determined in accordance with the rotation amount of the lifting motor 331, and the movement speed of the tray 302 is determined in accordance with the rotation speed of the lifting motor 331. Therefore, the controller of the post-processing apparatus 4 can control the lifting/lowering operation of the tray 302 by controlling the lifting motor 331.

To be noted, although the lifting mechanism 330 of a belt type has been described as an example of a lifting unit in the present embodiment, a different lifting unit may be used. For example, a configuration in which a motor and a pinion that is driven by the motor are disposed in the tray 302, the pinion is engaged with a rack provided in the apparatus body 40, and the tray 302 moves on the rack to ascend and descend may be employed. In addition, the lifting/lowering direction of the tray 302 by the lifting unit may be inclined with respect to the Z direction.

The side wall 305 of the apparatus body 40 includes a stacking wall 305*g* capable of abutting the trailing end of sheets stacked on the tray 302, that is, the upstream end of the sheets in the sheet discharge direction D, and frame portions 305*f* respectively provided on two sides of the stacking wall 305*g* in the X direction. The stacking wall 305*g* mainly extends in the lifting/lowering direction of the tray 302 (i.e., the Z direction) and the sheet width direction (i.e., the X direction). The frame portions 305*f* are preferably members rigid enough to support the weight of the lifting mechanism 330, the tray 302, and sheets of the maximum stacking amount on the tray 302, such as members having L shapes as viewed in the Z direction.

The stacking wall 305*g* is fixed to the frame member of the apparatus body 40, and does not move even in the case where the tray 302 is lifted or lowered. That is, the stacking wall 305*g* functions as a first abutting portion or first abutting member of the present embodiment that is capable of abutting or coming into contact with the trailing end of the sheets stacked on the stacking portion. However, there is no problem in making the stacking wall 305*g* movable not in accordance with the lifting and lowering of the tray 302, for example, by making the stacking wall 305*g* openable and closable or attachable to and detachable from the frame portions 305*f* for access to the inside of the apparatus body 40.

The stacking wall 305*g* includes a plurality of ribs 305*b* projecting to the first side in the Y direction, that is, to the downstream side in the sheet discharge direction D from a base surface extending in the X direction and the Z direction. The ribs 305*b* each extend in approximately the Z direction along the lifting/lowering direction of the tray 302. Ridge portions of the ribs 305*b* function as a contact portion or a first contact surface that comes into contact with the trailing end of the sheets stacked on the tray 302.

Slide Walls

As illustrated in FIGS. 2A, 3A, and 3B, slide walls 306 serving as second abutting portions or second abutting members movable with respect to the stacking wall 305*g* are provided in the discharge portion 300. A plurality of slide walls 306 can be arranged in the X direction. Particularly, in the present embodiment, two slide walls 306 are provided at positions symmetrical to each other in the X direction with respect to the center position of the discharge portion 300 in the X direction. The center position of the discharge portion 300 in the X direction is a center position between both end portion positions in the X direction of the outer circumferential surface of the discharge roller pair 301 serving as a discharge unit that comes into contact with the sheet.

The two slide walls 306 have substantially the same configuration except that the position thereof in the X direction is different. That is, the slide walls 306 each include a contact portion 306*b* serving as a second contact surface, which is a portion that comes into contact with the trailing end of the sheets stacked on the tray 302, and a pressed portion 306*a* and an abutting surface 306*c* related to position control of the slide wall 306.

At least part of the contact portion 306*b* projects toward the first side in the Y direction with respect to the ribs 305*b* of the stacking wall 305*g* serving as a first contact surface, that is, toward the downstream side in the sheet discharge direction D. Specifically, as illustrated in an enlarged portion of FIG. 3A, the contact portion 306*b* includes a main surface 306*b*1 extending in approximately the Z direction along the lifting/lowering direction of the tray 302 as viewed in the X direction, and an inclined surface 306*b*2 above and adjacent to the main surface 306*b*1. The inclined surface 306*b*2 extends from an upper end of the main surface 306*b*1 in a direction inclined upward in the Z direction toward a second side in the Y direction, that is, toward the upstream side in the sheet discharge direction D. An upper end of the inclined surface 306*b*2 is preferably retracted toward the second side in the Y direction, that is, toward the upstream side in the sheet discharge direction D, with respect to a tip end position of the ribs 305*b* in the Y direction. By providing the inclined surfaces 306*b*2, steps between the ribs 305*b* and the slide walls 306 can be eliminated to suppress the trailing end of the sheets getting caught by the steps.

At least part of a surface of each of the slide walls 306 opposite to the contact portion 306*b* is engaged with a guide groove 305*s* illustrated in FIGS. 2A and 3A having a slit shape defined along the Z direction on the stacking wall 305*g*. The slide walls 306 are movable in approximately the Z direction along the lifting/lowering direction of the tray 302 along predetermined trajectories determined by the shapes of the guide grooves 305*s* within the range of the guide grooves 305*s*. The guide grooves 305*s* extend linearly along the lifting/lowering direction of the tray 302 as viewed from the downstream side in the sheet discharge direction D and function as first guide portions that guide the slide walls 306 along a slide direction.

As schematically illustrated in FIG. 3A, the slide walls 306 are urged upward in the slide direction by spring members 307 serving as urging portions. For example, as the spring members 307, tension springs which are disposed such that the axial directions thereof are in approximately the Z direction and which interconnect second connecting portions 306*d* provided on the slide walls 306 and first connecting portions 305*h* of the stacking wall 305*g* provided above the second connecting portions 306*d* can be used. In addition, the spring members 307 are disposed inside the apparatus body 40 with respect to the stacking wall 305*g*, that is, further on the right side in FIG. 3A than the stacking wall 305*g* of the apparatus body 40. To be noted, although an example in which the urging portions are the spring members 307 that are torsion coil springs stretched between the stacking wall 305*g* and the slide walls 306 have been described, for example, different urging portions such as compression springs that press the slide walls 306 upward from below may be used.

The stacking wall 305*g* includes abutted portions 305*a* that the abutting surfaces 306*c* of the slide walls 306 abut. The abutted portions 305*a* function as positioning portions that position the slide walls 306 against the urging force of the spring members 307 by abutting the abutting surfaces 306*c* of the slide walls 306. In the description below, the positions of the slide walls 306 positioned by the abutted portions 305*a* will be referred to as initial positions or predetermined positions of the slide walls 306.

In addition, as illustrated in FIG. 3A, the tray 302 includes a pressing portion 302*a* that presses pressed portions 306*a* of the slide walls 306 to move the slide walls 306 in accordance with the tray 302. The pressing portion 302*a* functions as an engaging portion of the present embodiment, and the pressed portions 306*a* function as engaged portions of the present embodiment. The pressed portions 306*a* of the present embodiment are protrusions protruding in the Y direction intersecting with the Z direction, which is the lifting/lowering direction of the tray 302, and the pressing portion 302*a* is capable of abutting the upper surfaces of the protrusions to press the protrusions downward.

In the description below, the position of the tray 302 when the pressing portion 302*a* of the tray 302 first abuts the pressed portions 306*a* of the slide walls 306 in the case where the tray 302 is lowered from the home position will be referred to as an accompanying movement starting position of the tray 302. In other words, the accompanying movement starting position is a position of the tray 302 in the lifting/lowering direction serving as a boundary between a state in which the slide walls 306 move in accordance with the lifting and lowering of the tray 302 (i.e., state in which the slide walls 306 move accompanying or following the tray 302) and a state in which the slide walls 306 do not move in accordance with the lifting and lowering of the tray 302. The home position of the tray 302 serves as a first position of the present embodiment and the accompanying movement starting position of the tray 302 serves as a second position of the present embodiment.

To be noted, the lower limit position of the lifting/lowering range of the tray 302 is below the accompanying movement starting position in the Z direction. The lengths of the guide grooves 305*s* and the like that define the movement range of the slide walls 306 are preferably set such that the slide walls 306 move in accordance with the tray 302 while the tray 302 is lifted and lowered between the accompanying movement starting position and the lower limit position. That is, by setting enough lengths for the guide grooves 305*s* defined in the side wall 305, the slide walls 306 can be caused to move in accordance with the tray 302 in a desired part of the lifting/lowering range of the tray 302. In addition, the upper limit position of the lifting/lowering range of the tray 302 may coincide with the home position, and for example, may be above the home position.

Next, the motion of the slide walls 306 will be described with reference to FIGS. 4A to 5B. The left side of FIG. 4A illustrates a region encircled by a broken line in FIG. 3A, and the right side of FIG. 4A is an enlarged view of part of this region. FIGS. 4B to 5B respectively illustrate the same ranges on the left side and the right side thereof.

FIG. 4A illustrates a state when the tray 302 is at the home position and sheets have begun being discharged by the discharge roller pair 301 one after another and stacked on the tray 302. At this time, the pressing portion 302*a* of the tray 302 is separated upward from the pressed portions 306*a* of the slide walls 306. When a sheet falls onto the upper surface of a sheet bundle already stacked on the tray 302, the sheet moves upstream in the sheet discharge direction D due to the inclination of the tray 302, and stops as a result of the trailing end thereof abutting the ribs 305*b* of the stacking wall 305*g*. Therefore, sheets are stacked on the tray 302 in a state in which the trailing end position thereof is regulated by the ribs 305*b*.

Figure 4B:
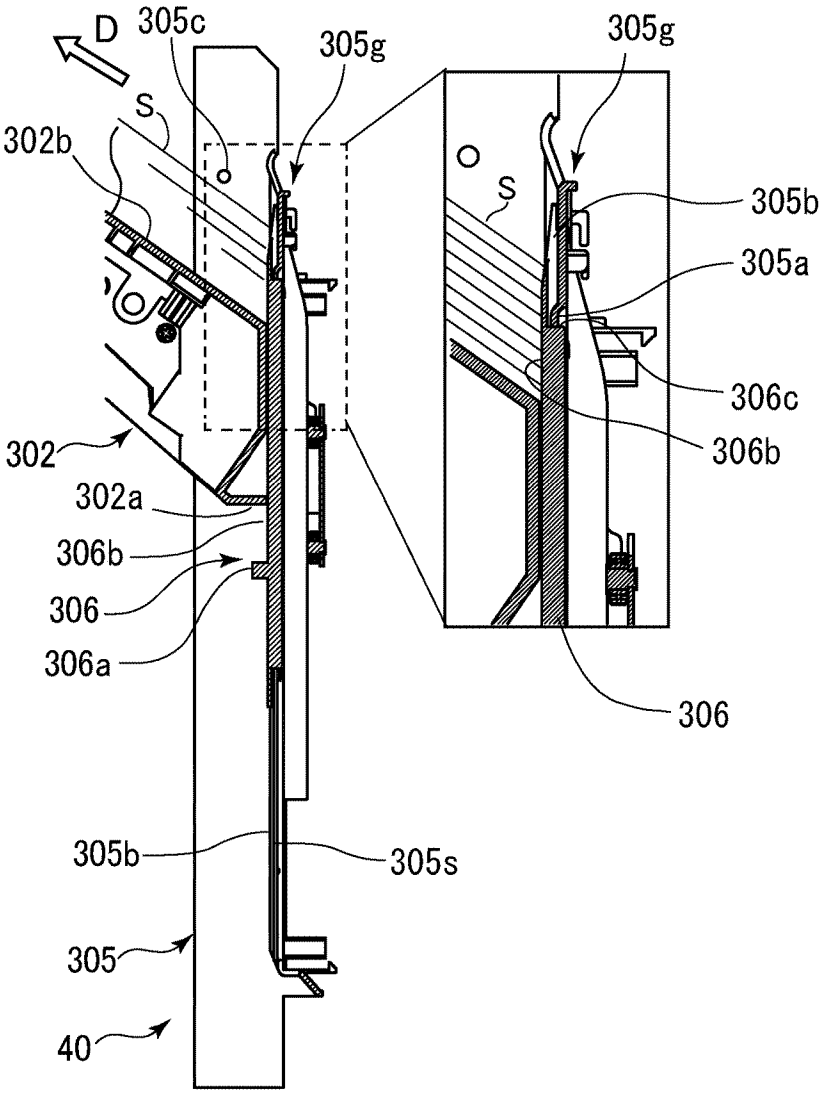
FIGS. 4A and 4B are diagrams illustrating a motion of the sheet discharge portion according to the first embodiment.
Figure 4A:
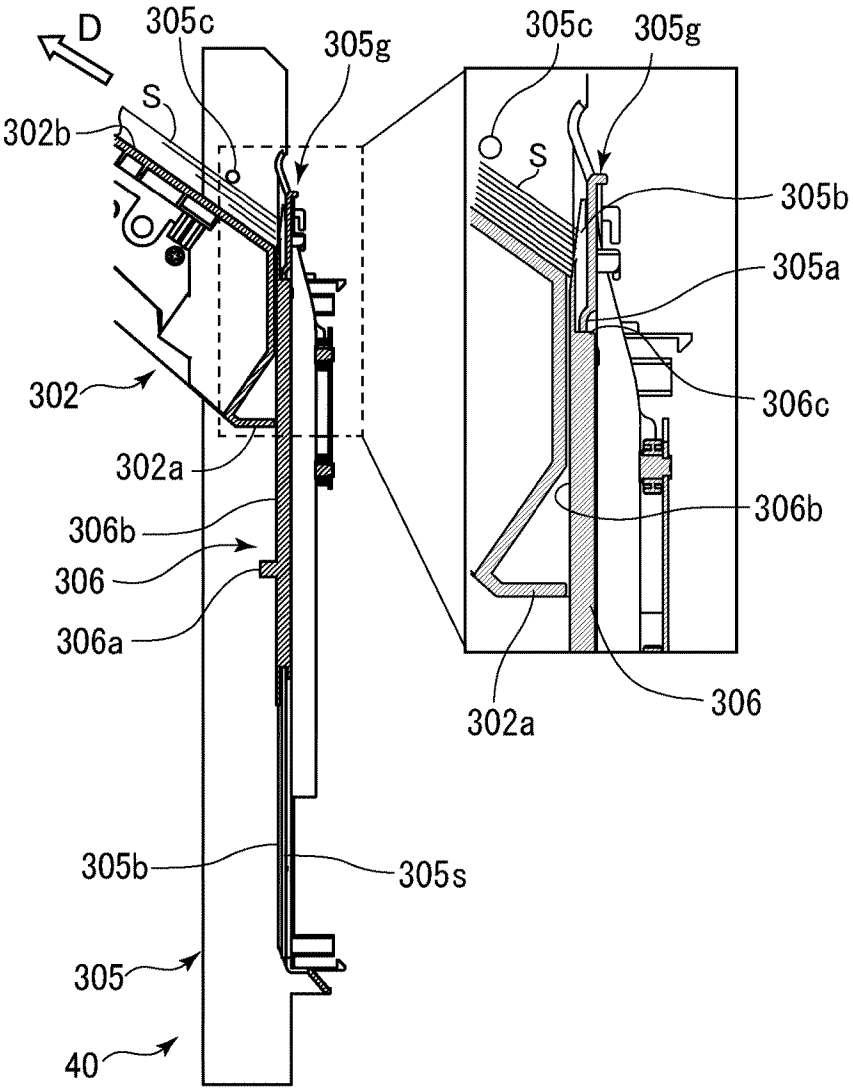

FIG. 4B illustrates a state after the upper surface of the sheets stacked on the tray 302 has exceeded the detection height of the sheet surface detection sensor 305*c* after the state of FIG. 4A and therefore the lowering movement of the tray 302 has been performed. Since the tray 302 has been lowered, the upper surface of the sheets has moved to a position below the detection position of the sheet surface detection sensor 305*c*. At this time, the tray 302 is positioned between the home position and the accompanying movement starting position, and the pressing portion 302*a* of the tray 302 is still separated from the pressed portions 306*a* of the slide walls 306.

Here, when the tray 302 is lowered from the home position of FIG. 4A to the position of FIG. 4B, the trailing end of the sheets stacked on the tray 302 rubs the contact portions 306*b* of the slide walls 306 and the ribs 305*b* of the stacking wall 305*g*. However, at this stage, the amount of sheets stacked on the tray 302 is relatively small, and upstream force in the sheet discharge direction D acting on the sheets due to the inclination of the tray 302 is relatively small. Therefore, even if the trailing end of the sheets rubs the slide walls 306 and the ribs 305*b* as a result of the lowering of the tray 302, the possibility of occurrence of noises or damage to the trailing end of the sheets is low.

Figure 5B:
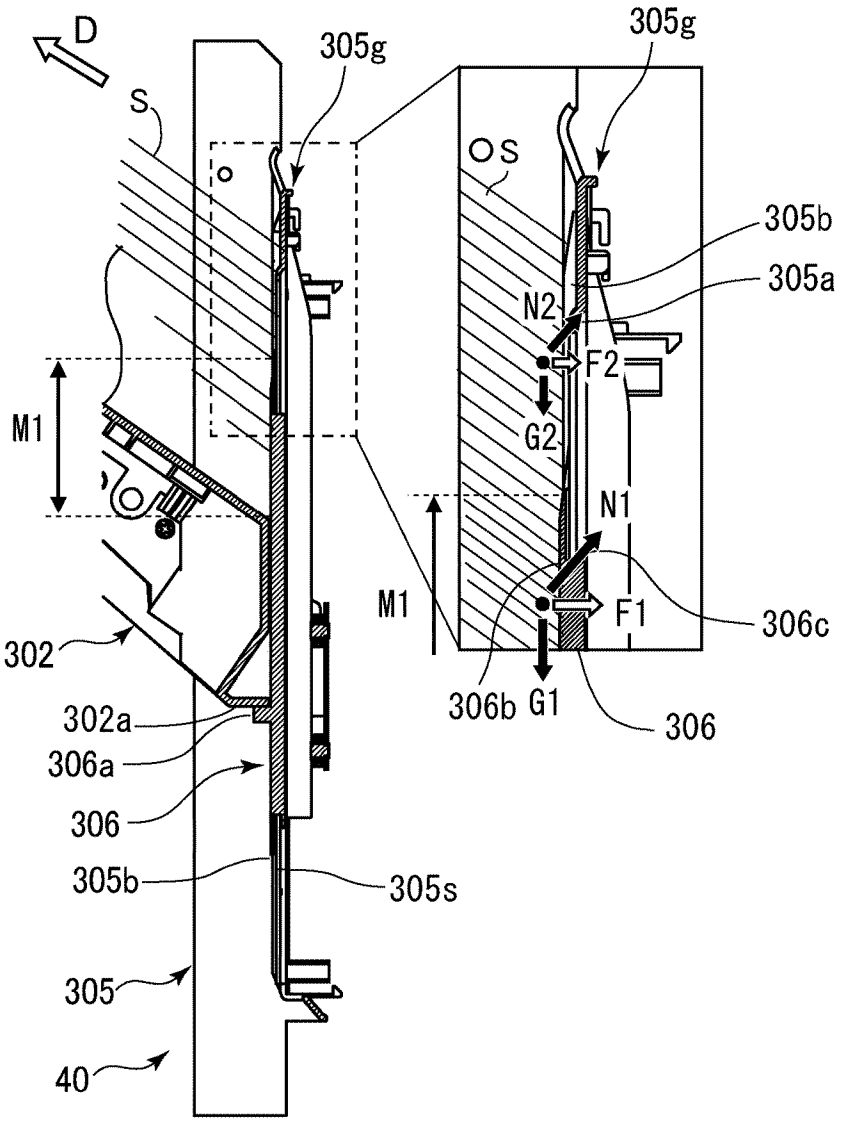
FIGS. 5A and 5B are diagrams illustrating a motion of the sheet discharge portion according to the first embodiment.
Figure 5A:
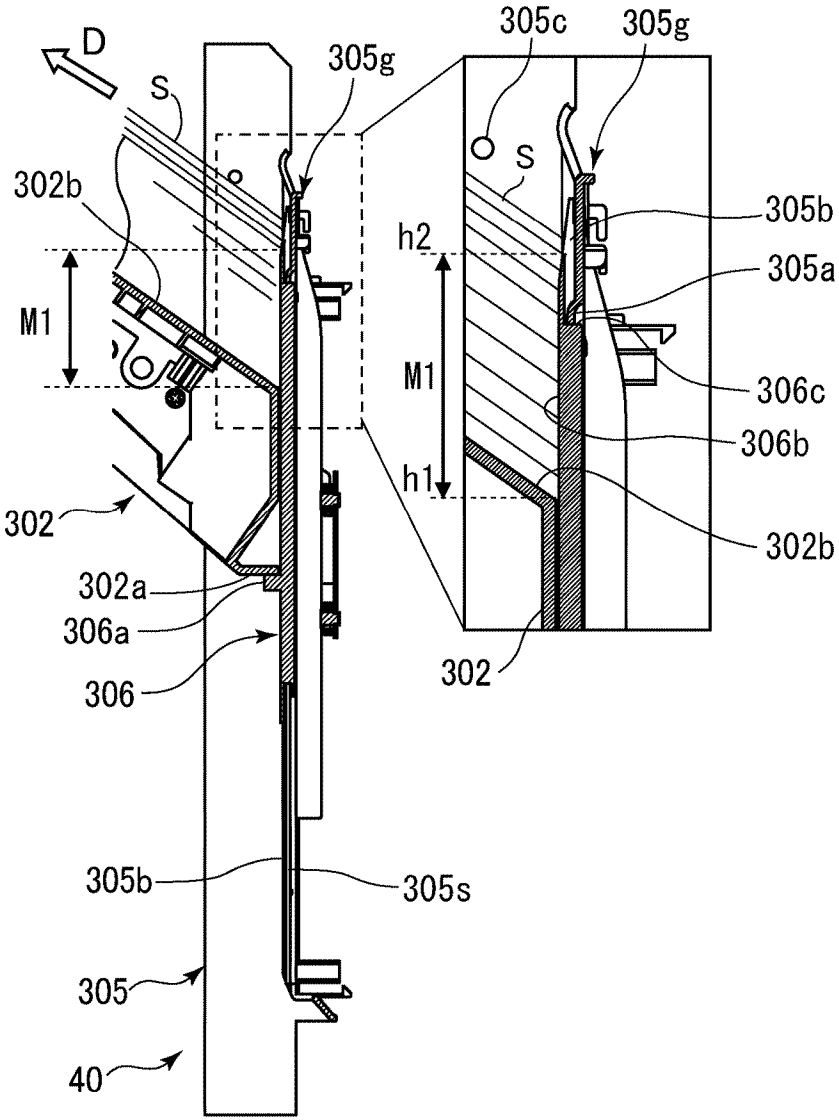

FIG. 5A illustrates a state at the time when the tray 302 has been lowered further from the position of FIG. 4B and reached the accompanying movement starting position. That is, at this time, the pressing portion 302*a* of the tray 302 abuts the pressed portions 306*a* of the slide walls 306. As a result of this, the slide walls 306 starts sliding downward in the Z direction in accordance with the lowering of the tray 302.

Here, the height to which the contact portions 306*b* of the slide walls 306 project upward with respect to the supporting surface 302*b* of the tray 302 in a state in which the tray 302 is in the accompanying movement starting position of FIG. 4B will be referred to as a wall surface height M1 of the slide walls 306. More specifically, the wall surface height M1 is a distance in the lifting/lowering direction between a height h1 of an upstream end of the supporting surface 302*b* in the sheet discharge direction D and an upper end height h2 of the contact portions 306*b* of the slide walls 306 in the state in which the tray 302 is in the accompanying movement starting position. The wall surface height M1 of the slide walls 306 indicates the maximum amount of sheets whose trailing end can be held by the slide walls 306 among the sheet bundle stacked on the tray 302.

When the tray is lowered to a position below the accompanying movement starting position, the slide walls 306 slide downward in accordance with the tray 302. Therefore, among the sheet bundle supported on the tray 302, the trailing end of sheets at the wall surface height M1 of the slide walls 306 and below are held by the contact portions 306*b* of the slide walls 306, and moves without rubbing the ribs 305*b* of the stacking wall 305*g*. Therefore, the occurrence of noises and damage to the trailing end of the sheets caused by rubbing the ribs 305*b* can be suppressed for sheets up to the wall surface height M1 of the slide walls 306.

FIG. 5B illustrates a state in which the tray 302 has been lowered further from the state of FIG. 5A and is positioned below the accompanying movement starting position. At this time, sheets are stacked on the tray 302 to a height higher than the wall surface height M1 of the slide walls 306. The trailing end of the sheets mainly move without rubbing the stacking wall 305*g* in the state of being held by the slide walls 306 for sheets up to the wall surface height M1 of the slide walls 306.

Incidentally, there is a possibility that the trailing end of sheets positioned higher than the wall surface height M1 of the slide walls 306 rubs the ribs 305*b* of the stacking wall 305*g* as the tray 302 is lowered. However, the magnitude of force (e.g., F1 and F2 in FIG. 5B) by which the trailing end of the sheets abuts the stacking wall 305*g* or the slide walls 306 is smaller for sheets positioned higher in the sheet bundle stacked on the tray 302 than for sheets positioned lower in the sheet bundle. That is, F1>F2 holds in the situation of FIG. 5B.

This can be explained as follows.

On each sheet of the sheet bundle, downward force G1 or G2 in the Z direction derived from the gravity and normal force N1 or N2 received from sheets lower than the sheet, or received from the supporting surface 302*b* in the case where the sheet is the lowermost sheet, act.

The direction of the force N1 or N2 is inclined toward the second side in the Y direction in the Z direction, that is, toward the upstream side in the sheet discharge direction D due to the inclination of the supporting surface 302*b*.

When the tray 302 is not moving, the Z-direction component of the force N1 or N2 is equal to the force G1 or G2 due to the balance of force in the Z direction.

Here, the force G1 or G2 derived from the gravity is a force derived from not only the weight of the sheet of interest itself but also the weight of other sheets stacked thereon. Therefore, the force G1 that acts on a lower sheet is larger than the force G2 that acts on a higher sheet. That is, G1>G2 holds.

Therefore, the force N1 that acts on a lower sheet is larger than the force N2 that acts on a higher sheet. That is, N1>N2 holds.

As a result, regarding the force pushing the trailing end of a sheet against the stacking wall 305*g* or the slide walls 306, that is, the Y-direction component of the force N1 or N2, a force F1 that acts on a lower sheet is larger, and a force F2 that acts on a higher sheet is smaller. That is, F1>F2 holds.

To be noted, although frictional force between sheets also actually acts on each sheet, there is still a fact that there is a difference between forces by which the trailing ends of sheets abut the stacking wall 305*g* or the slide walls 306.

As described above, it can be seen that sheets stacked to a position higher than the wall surface height M1 of the slide walls 306 come into contact with the stacking wall 305*g* by a force smaller than a force by which sheets stacked to a position equal to or lower than the wall surface height M1 abut the slide walls 306. The former force corresponds to the force F2, and the latter corresponds to the force F1. That is, it can be seen that lower layers of the sheet bundle of sheets of a relatively large amount staked on the tray 302 strongly rub sheets, the stacking wall 305*g*, and so forth and serve as a main cause of noises when the tray 302 is lowered. Therefore, noises caused by vibration of sheets and damage to the trailing end of sheets are not likely to occur even if the trailing end of sheets stacked to a position higher than the wall surface height M1 of the slide walls 306 rub the ribs 305*b* of the stacking wall 305*g* in accordance with the lowering of the tray 302.

Advantages of Present Embodiment

According to the present embodiment, in the case where the tray 302 is lowered through the accompanying movement starting position, the slide walls 306 move in accordance with the tray 302 when the tray 302 is positioned below the accompanying movement starting position. In other words, in the case where a stacking portion is lowered from a first position through a second position below the first position, a second abutting portion or a second abutting member of the present embodiment is positioned at a predetermined position and does not move down in accordance with the stacking portion when the stacking portion is lowered from the first position to the second position (i.e., before the stacking portion passes the second position), and moves down from the predetermined position in accordance with the stacking portion when the stacking portion is lowered beyond the second position.

As a result of this, occurrence of noises and the like caused by rubbing in a state in which a sheet bundle of a relatively large amount is stacked on the tray 302, in which issues such as noises and damage to sheets are likely to be caused by the trailing end of the sheets rubbing a fixed abutting portion such as the stacking wall 305*g*. Therefore, occurrence of noises and the like caused by the sheets rubbing the abutting portion can be effectively suppressed by a configuration in which the slide walls 306 are configured to move in accordance with the tray 302 in part of a lifting/lowering range of the tray 302.

In addition, since the slide walls 306 of the present embodiment are members slidably supported by the stacking wall 305*g*, the occurrence of noises caused by rubbing by the sheets can be suppressed by a simpler configuration than in the case of, for example, using a belt member stretched over a plurality of pulleys.

MODIFICATION EXAMPLE

Although the two slide walls 306 having elongated plate shapes extending in the Z direction are used in the present embodiment, the shape and number of the second abutting portions or second abutting members may be arbitrarily changed. For example, the slide walls 306 of the present embodiment may be connected in the X direction and be integrated to have a single wide plate shape. In addition, freely rotatable roller members may be attached to the slide walls 306 such that the slide walls 306 come into contact with the wall surface of the guide grooves 305*s* via the roller members.

Second Embodiment

The discharge portion 300 serving as a sheet stacking apparatus according to a second embodiment will be described with reference to FIGS. 6A to 8B. The configuration of the discharge portion 300 that will be described later is suitably used for, for example, the lower discharge portion 300B of the post-processing apparatus 4 described above. That is, the discharge portion 300 of the first embodiment can be used as the upper discharge portion 300A of the post-processing apparatus 4 of FIG. 1, and the discharge portion 300 of the present embodiment can be suitably used as the lower discharge portion 300B of the post-processing apparatus 4. However, the discharge portion 300 of the present embodiment may be also used as the upper discharge portion 300A of the post-processing apparatus 4. In the description below, it is assumed that elements denoted by the same reference signs as in the first embodiment have substantially the same configurations and effects as in the first embodiment.

Figure 6A:
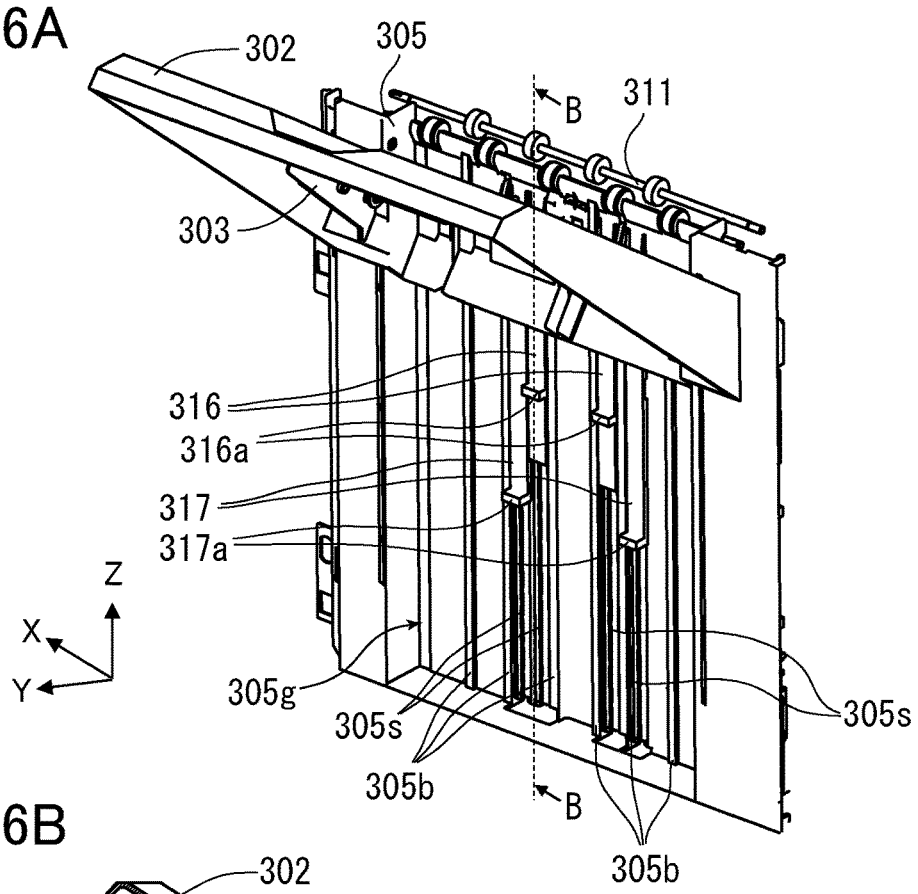
FIGS. 6A and 6B are diagrams illustrating a motion of a sheet discharge portion according to a second embodiment.
Figure 6B:
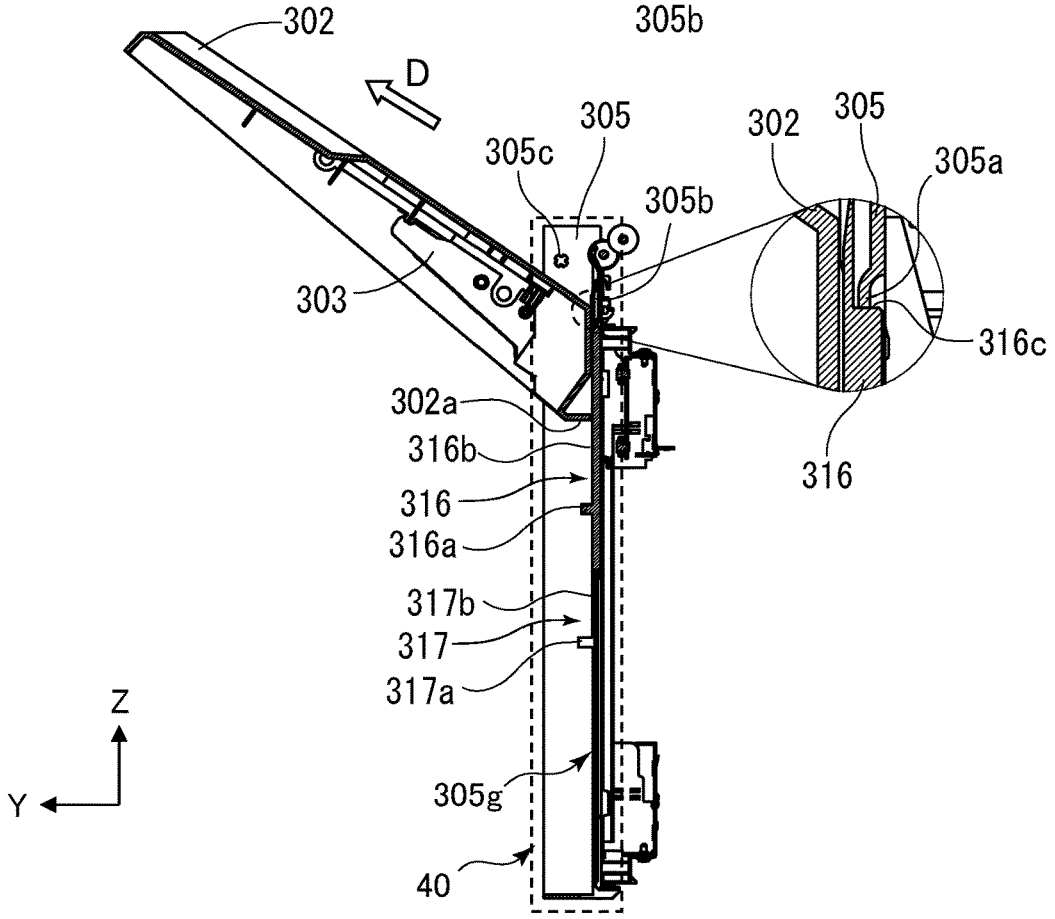

FIG. 6A is a perspective view of the discharge portion 300 according to the present embodiment, and FIG. 6B is a section view taken along a line B-B of FIG. 6A, which sections one of slide walls 316 that will be described later.

As illustrated in FIGS. 6A and 6B, the discharge portion 300 includes a discharge roller pair 311 and the tray 302. In addition, the discharge portion 300 includes the stacking wall 305*g* and the slide walls 316 that are provided on a side surface of the apparatus body 40 in the Y direction. The discharge roller pair 311 is another example of a discharge unit. The tray 302 can be lifted and lowered in approximately the Z direction with respect to the stacking wall 305*g* by the lifting mechanism 330 similarly to the first embodiment.

As illustrated in FIG. 6A, the discharge portion 300 of the present embodiment is provided with first slide walls 316 serving as second abutting portions or second abutting members movable with respect to the stacking wall 305*g*, and second slide walls 317 serving as third abutting portions or third abutting members movable with respect to the stacking wall 305*g* independently of the second abutting portions or second abutting members. Two first slide walls 316 are provided at positions symmetrical to each other in the X direction with respect to the center position of the discharge portion 300 in the X direction. In addition, two second slide walls 317 are provided at positions further on the outside than the slide walls 316 and symmetrical to each other in the X direction with respect to the center position of the discharge portion 300 in the X direction.

The configuration of the first slide walls 316 is substantially the same as the slide walls 306 of the first embodiment. That is, the first slide walls 316 are slidable in approximately the Z direction along the guide grooves 305*s* provided in the stacking wall 305*g*. Abutting surfaces 316*c* of the first slide walls 316 are caused to abut the abutted portions 305*a* of the stacking wall 305*g* by the urging force of the spring members 307 illustrated in FIG. 2A as illustrated in FIG. 6B when the tray 302 is positioned above the accompanying movement starting position, and is thus positioned in initial positions. In addition, when the tray 302 is positioned below the accompanying movement starting position, the pressing portion 302*a* of the tray 302 presses pressed portions 316*a* of the first slide walls 316, and thus the first slide walls 316 ascend and descend in accordance with the tray 302.

The configuration of the second slide walls 317 is substantially the same as that of the first slide walls 316 except that the setting of the accompanying movement starting position is different from that of the first slide walls 316. That is, the second slide walls 317 each include a contact portion 317*b* that comes into contact with the trailing end of the sheets stacked on the tray 302, a pressed portion 317*a* that is a protrusion pressed by the pressing portion 302*a* of the tray 302, and an abutting surface that abuts the abutted portion 305*a* of the stacking wall 305*g*. The second slide walls 317 are slidable in approximately the Z direction along the guide grooves 305*s* provided in the stacking wall 305*g*.

The second slide walls 317 are positioned at initial positions illustrated in FIGS. 6A and 6B when the tray 302 is positioned above an accompanying movement starting position for the second slide walls 317 below the home position, where the accompanying movement starting position for the first slide walls 316 is a first accompanying movement starting position, and the accompanying movement starting position for the second slide walls 317 is a second accompanying movement starting position. At this time, the second slide walls 317 are caused to abut the abutted portions 305*a* of the stacking wall 305*g* by the urging force of spring members similar to the spring members 307 of the first embodiment illustrated in FIG. 2A, and are thus positioned in initial positions. In addition, when the tray 302 is positioned below the second accompanying movement starting position, the pressing portion 302*a* of the tray 302 presses the pressed portions 317*a* of the second slide walls 317, and thus the second slide walls 317 ascend and descend in accordance with the tray 302.

To be noted, contact portions 316*b*, which are parts of the first slide walls 316 serving as second abutting portions where the first slide walls 316 come into contact with the trailing end of the sheets and which serve as second contact surfaces, project further toward the first side in the Y direction, that is, toward the downstream side in the sheet discharge direction D than contact portions 317*b*, which are parts of the second slide walls 317 serving as third abutting portions where the second slide walls 317 come into contact with the trailing end of the sheets and which serve as third contact surfaces. In addition, the contact portions 317*b* of the second slide walls 317 project further toward the first side in the Y direction than the ribs 305*b* of the stacking wall 305*g* serving as a third contact surface.

The home position of the tray 302 serves as a first position of the present embodiment, the first accompanying movement starting position for the first slide walls 316 serves as a second position of the present embodiment, and the second accompanying movement starting position for the second slide walls 317 serves as a third position of the present embodiment.

Here, the position of the tray 302 where the second slide walls 317 start moving in accordance with the tray 302, that is, the second accompanying movement starting position, is set to be lower than the position of the tray 302 where the first slide walls 316 start moving in accordance with the tray 302, that is, the first accompanying movement starting position, in the case where the tray 302 is lowered from the home position. Specifically, the pressed portions 317*a* of the second slide walls 317 are configured to be positioned below the pressed portions 316*a* of the first slide walls 316 in a state in which the first slide walls 316 and the second slide walls 317 are respectively at the initial positions thereof. As a result of this configuration, in the lowering of the tray 302, the pressing portion 302*a* abuts the pressed portions 317*a* of the second slide walls 317 at a timing later than the timing at which the pressing portion 302*a* abuts the pressed portions 316*a* of the first slide walls 316 as will be described later.

The motions of the first slide walls 316 and the second slide walls 317 will be described with reference to FIGS. 7A to 8B. The left side of FIG. 7A illustrates a region encircled by a broken line in FIG. 6B, and the right side of FIG. 7A is an enlarged view of part of this region. FIGS. 7B to 8B respectively illustrate the same ranges on the left side and the right side thereof.

FIG. 7A illustrates a state when the tray 302 is at the home position and sheets have begun being discharged by the discharge roller pair 301 one after another and stacked on the tray 302. At this time, the pressing portion 302*a* of the tray 302 is separated upward from the pressed portions 316*a* and 317*a* of the first slide walls 316 and the second slide walls 317. When a sheet falls onto the upper surface of a sheet bundle already stacked on the tray 302, the sheet moves upstream in the sheet discharge direction D due to the inclination of the tray 302, and stops as a result of the trailing end thereof abutting the ribs 305*b* of the stacking wall 305*g*. Therefore, sheets are stacked on the tray 302 in a state in which the trailing end position thereof is regulated by the ribs 305*b*.

While the tray 302 is lowered from the home position of FIG. 7A to the first accompanying movement starting position, the trailing end of the sheets stacked on the tray 302 rubs the contact portions 316*b* of the first slide walls 316 and the ribs 305*b* of the stacking wall 305*g*. However, since the amount of sheets stacked on the tray 302 is relatively small at this stage, the possibility of occurrence of issues such as noises is low.

Figure 7B:
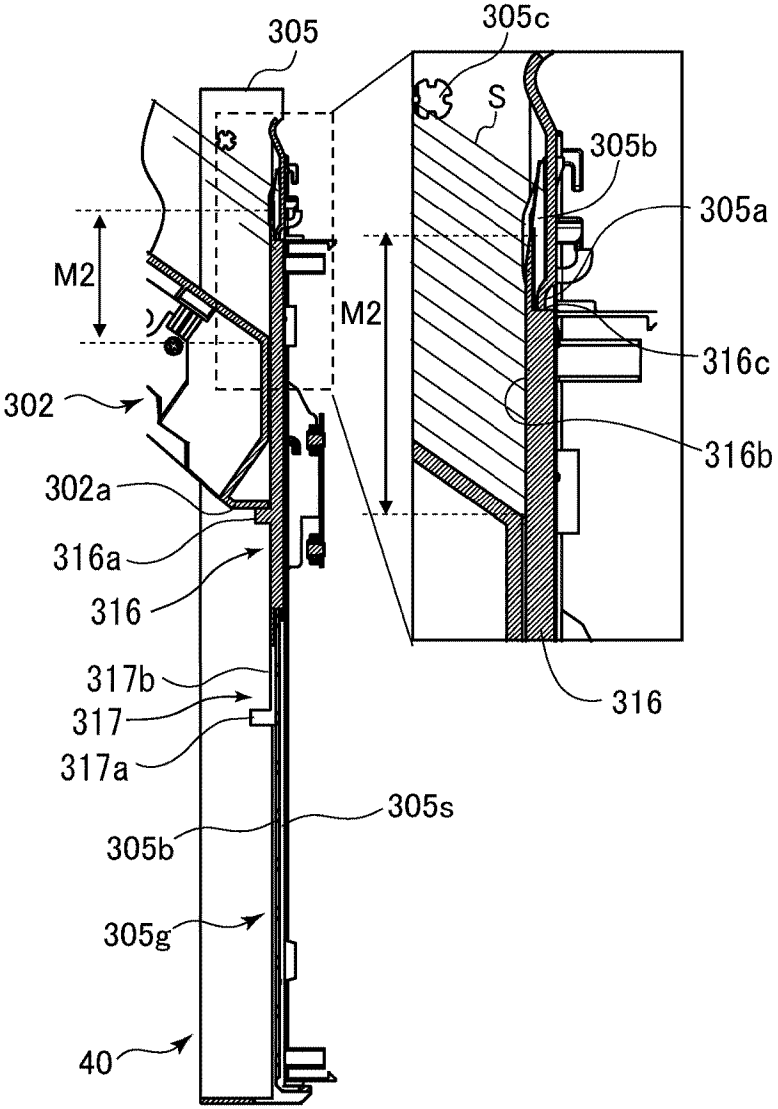
FIGS. 7A and 7B are diagrams illustrating a motion of the sheet discharge portion according to the second embodiment.
Figure 7A:
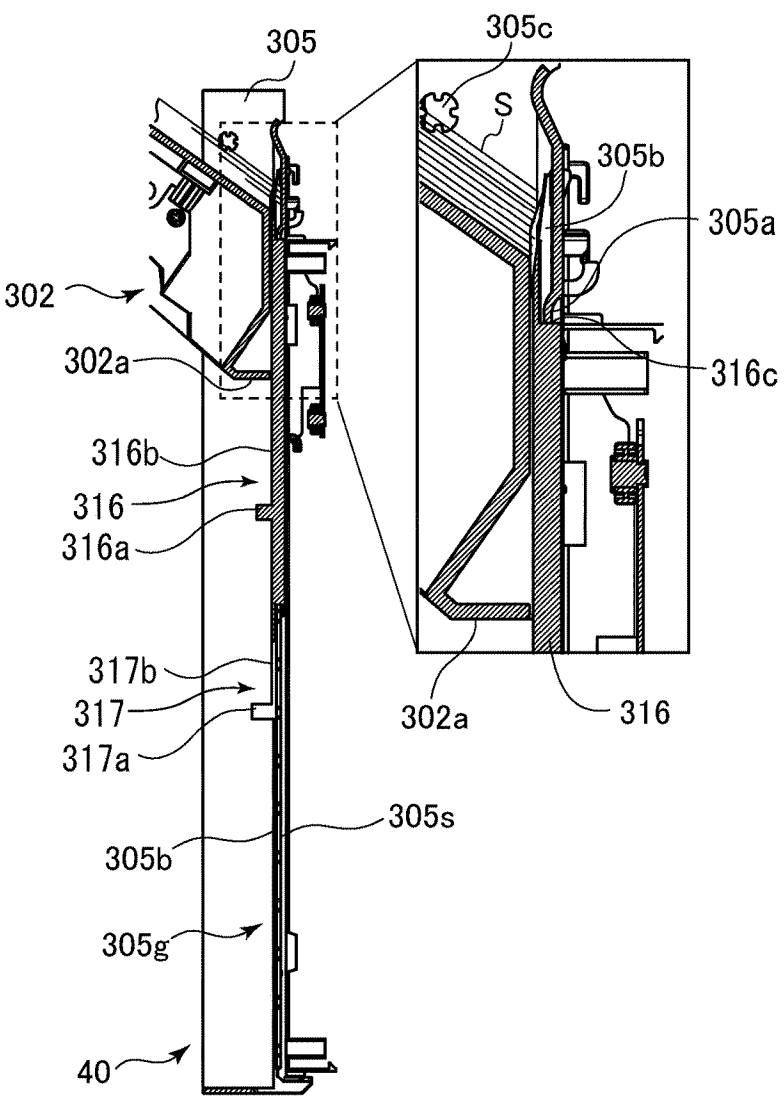

FIG. 7B illustrates a state in which the tray 302 has been lowered to the first accompanying movement starting position. At this time, the pressing portion 302*a* of the tray 302 abuts the pressed portions 316*a* of the first slide walls 316, and a state in which the first slide walls 316 descends in accordance with the lowering of the tray 302 is taken. FIG. 8A illustrates a state when the tray 302 has been lowered from the position of FIG. 7B to a position between the first accompanying movement starting position and the second accompanying movement starting position. By comparing FIG. 8A with FIG. 7B, it can be seen that the first slide walls 316 have moved downward by following the lowering of the tray 302. In contrast, the pressing portion 302*a* of the tray 302 is still separated upward from the pressed portions 317*a* of the second slide walls 317, and the second slide walls 317 are still at the initial positions.

Here, the height to which the contact portions 316*b* of the first slide walls 316 project upward with respect to the supporting surface 302*b* of the tray 302 in a state in which the tray 302 is in the first accompanying movement starting position of FIG. 7B will be referred to as a wall surface height M2 of the first slide walls 316. Among the sheet bundle supported on the tray 302, the trailing end of sheets at the wall surface height M2 of the first slide walls 316 and below are held by the first slide walls 316, and therefore mainly moves without contact with the ribs 305*b* of the stacking wall 305*g*. Therefore, similarly to the case described in the first embodiment, in the case where the tray 302 is lifted and lowered in a range below the first accompanying movement starting position, sheets up to the wall surface height M2 of the first slide walls 316 mainly do not rub the stacking wall 305*g*.

To be noted, in the case where the tray 302 is lifted and lowered in a region between the first accompanying movement starting position and the second accompanying movement starting position, the trailing end of sheets stacked higher than the wall surface height M2 of the first slide walls 316 rubs the ribs 305*b* of the stacking wall 305*g*. However, as described above, the force by which sheets higher in the sheet bundle stacked on the tray 302 abut the stacking wall 305*g* is smaller than the force by which lower sheets abut the first slide walls 316 as illustrated in FIG. 5B. Therefore, issues such as noises are not likely to occur even in the case where the trailing end of the sheets stacked higher than the wall surface height M2 of the first slide walls 316 rubs the ribs 305*b* of the stacking wall 305*g* due to the lifting and lowering of the tray 302.

In addition, since the first slide walls 316 project further than the second slide walls 317, sheets up to the wall surface height M2 of the first slide walls 316 mainly do not rub the second slide walls 317 while the tray 302 is lifted and lowered between the first accompanying movement starting position and the second accompanying movement starting position.

Figure 8B:
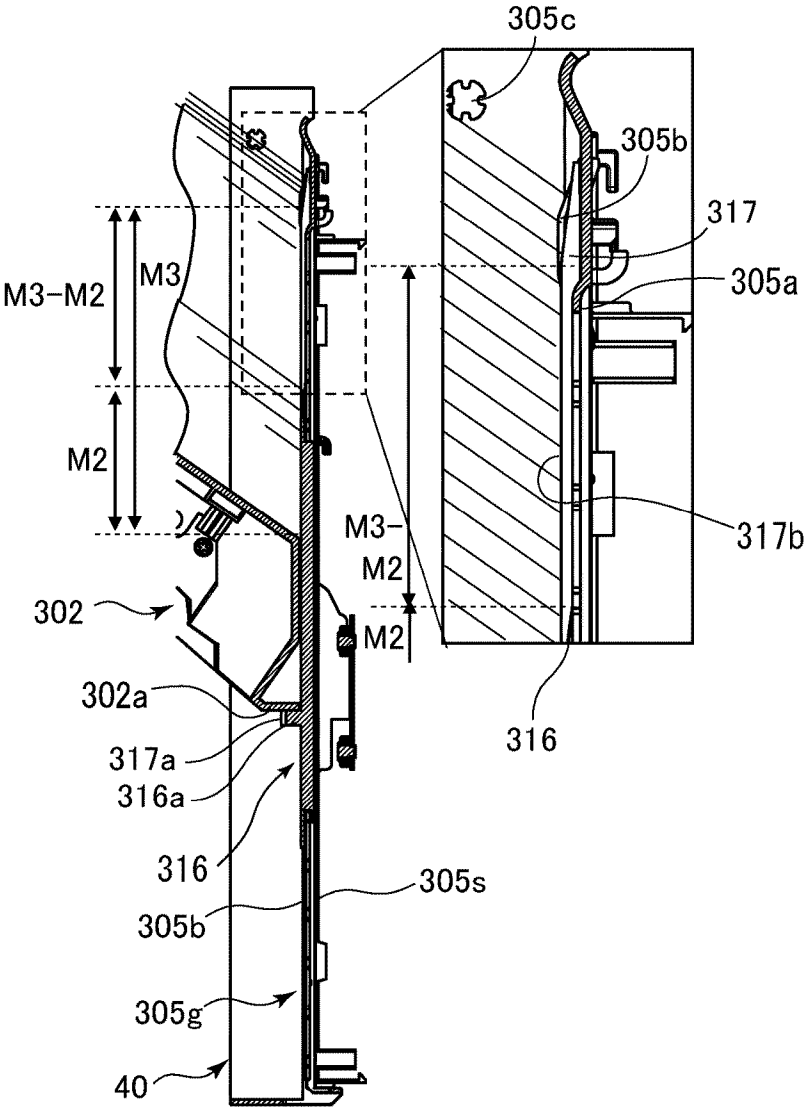
FIGS. 8A and 8B are diagrams illustrating a motion of the sheet discharge portion according to the second embodiment.
Figure 8A:
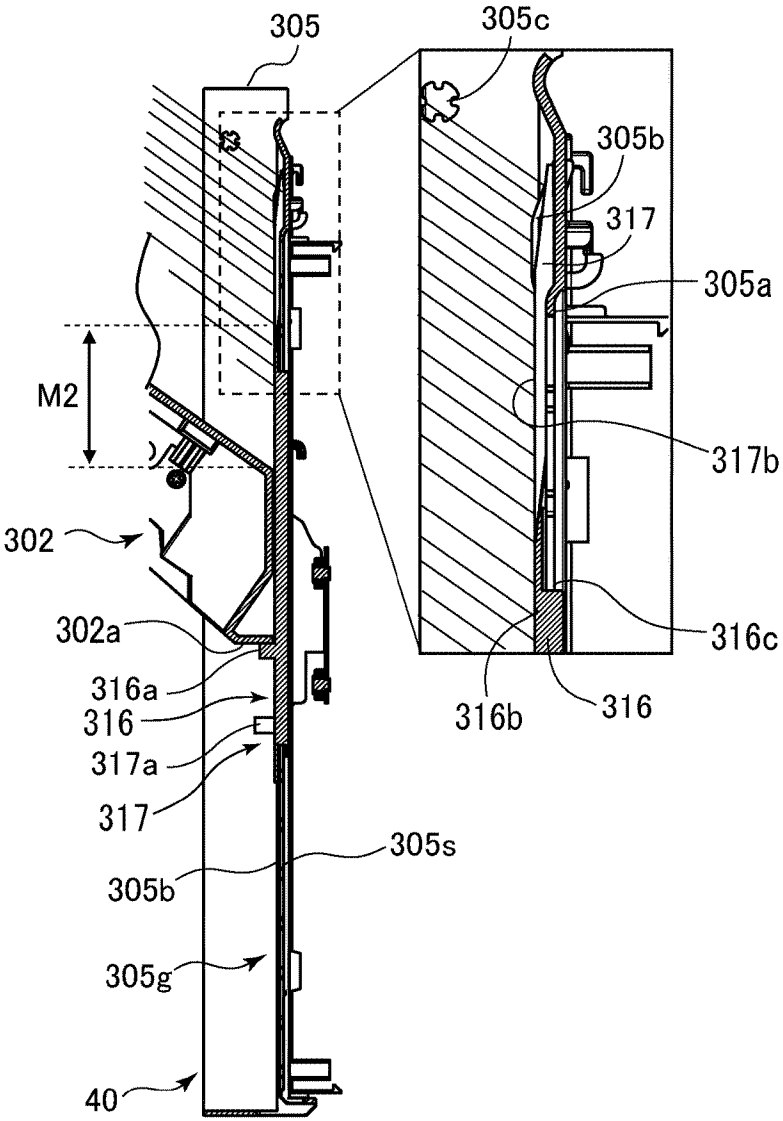

FIG. 8B illustrates a state in which the tray 302 has been further lowered to the second accompanying movement starting position. At this time, the pressing portion 302*a* of the tray 302 abuts the pressed portions 317*a* of the second slide walls 317, and a state in which the first slide walls 316 and the second slide walls 317 descend in accordance with the lowering of the tray 302 is taken.

Here, the height to which the contact portions 317*b* of the second slide walls 317 project upward with respect to the supporting surface 302*b* of the tray 302 in a state in which the tray 302 is in the second accompanying movement starting position of FIG. 8B will be referred to as a wall surface height M3 of the second slide walls 317. Among the sheet bundle supported on the tray 302, the trailing end of sheets within a region M3-M2 from the wall surface height M2 of the first slide walls 316 to the wall surface height M3 of the second slide walls 317 is held by the second slide walls 317, and therefore mainly does not contact the ribs 305*b* of the stacking wall 305*g*. That is, the contact portions 317*b* of the second slide walls 317 serving as third abutting portions or third abutting members are capable of coming into contact with the trailing end of sheets in the region M3-M2 higher than the contact portions 316*b* of the first slide walls 316 serving as second abutting portions or second abutting members. Therefore, in the case where the tray 302 is lifted and lowered in a region below the second accompanying movement starting position, sheets up to the wall surface height M3 of the second slide walls 317 mainly do not rub the stacking wall 305*g*.

To be noted, in the case where the tray 302 is lifted and lowered in a region below the second accompanying movement starting position, the trailing end of sheets stacked higher than the wall surface height M3 of the second slide walls 317 rubs the ribs 305*b* of the stacking wall 305*g*. However, the force by which sheets stacked higher in the sheet bundle stacked on the tray 302 abut the stacking wall 305*g* is smaller than the force by which lower sheets abut the first slide walls 316 or the second slide walls 317. Therefore, issues such as noises are not likely to occur even in the case where the trailing end of the sheets stacked higher than the wall surface height M3 of the second slide walls 317 rubs the ribs 305*b* of the stacking wall 305*g* due to the lifting and lowering of the tray 302.

As described above, in the present embodiment, the second slide walls 317 serving as third abutting portions or third abutting members capable of moving in accordance with the lowering of the stacking portion are provided in addition to the first slide walls 316 serving as second abutting portions or second abutting members. As a result of this, occurrence of noises and the like caused by the rubbing by the sheets can be suppressed similarly to the first embodiment.

Further, according to the present embodiment, the performance of suppressing the occurrence of noises and the like caused by rubbing by the sheets can be improved in both cases where the amount of sheets stacked on the tray 302 is small and large. For example, if it is attempted to increase the amount of sheets that do not come into contact with the stacking wall 305*g* by increasing the wall surface height M1 of the slide walls 306 in the configuration of the first embodiment, the amount of sheets stacked before the tray 302 reaches the accompanying movement starting position for the slide walls 306 increases. It can be considered that as a result of this, issues such as noises caused by the rubbing between the sheets and the slide walls 306 occur before the slide walls 306 start moving in accordance with the tray 302. In contrast, if the wall surface height M1 of the slide walls 306 is reduced, it can be considered that the proportion of the sheets stacked higher than the wall surface height M1 increases, and issues such as noises caused by the rubbing between the sheets and the stacking wall 305*g* occur.

In contrast, according to the present embodiment, such inconvenience can be avoided by using in combination the two kinds of slide walls 316 and 317 having different standards for the sheet stacking amount on the tray 302 at the time of start of the accompanying movement with the tray 302. That is, since the second slide walls 317 that abut the trailing end of sheets in a region above the first slide walls 316 are provided, the occurrence of noises and the like caused by the rubbing by the sheets can be suppressed more than in the case where only the first slide walls 316 are provided even in a state in which a large amount of sheets are stacked on the tray 302. In addition, in the case where the amount of sheets stacked on the tray 302 is relatively small, the first slide walls 316 start moving in accordance with the tray 302 while the second slide walls 317 are still in the initial positions, and thus the occurrence of noises and the like caused by the rubbing by the sheets can be suppressed.

MODIFICATION EXAMPLE

To be noted, the configuration in which the first accompanying movement starting position and the second accompanying movement starting position of the tray 302 are varied is not limited to the configuration described above in which the positions of the pressed portions 316*a* and 317*a* in the Z direction are varied. For example, forming the pressing portion 302*a* of the tray 302 in a shape whose height in the Z direction is different between a region for pressing the pressed portions 316*a* of the first slide walls 316 and a region for pressing the pressed portions 317*a* of the second slide walls 317 can be considered.

In addition, although a configuration in which the second slide walls 317 are directly pressed by the tray 302 and thus move in accordance with the tray 302 is employed in the present embodiment, a configuration in which the second slide walls 317 move in accordance with the lowering of the tray 302 via the first slide walls 316 may be employed. For example, the pressed portions 317*a* of the second slide walls 317 may be formed in shapes projecting in the X direction to be pressed by the lower surfaces of the pressed portions 316*a* of the first slide walls 316. In addition, although two kinds of slide walls having different wall surface heights are used in the present embodiment, three or more kinds of slide walls having different wall surface heights may be used.

Third Embodiment

The discharge portion 300 serving as a sheet stacking apparatus according to a third embodiment will be described with reference to FIGS. 9A and 9B. For example, the configuration of the discharge portion 300 that will be described below is suitably used as the upper or lower discharge portion 300A or 300B in the post-processing apparatus 4 described above. In the description below, it is assumed that elements denoted by the same reference signs as in the first embodiment have substantially the same configurations and effects as in the first embodiment.

Figure 9A:
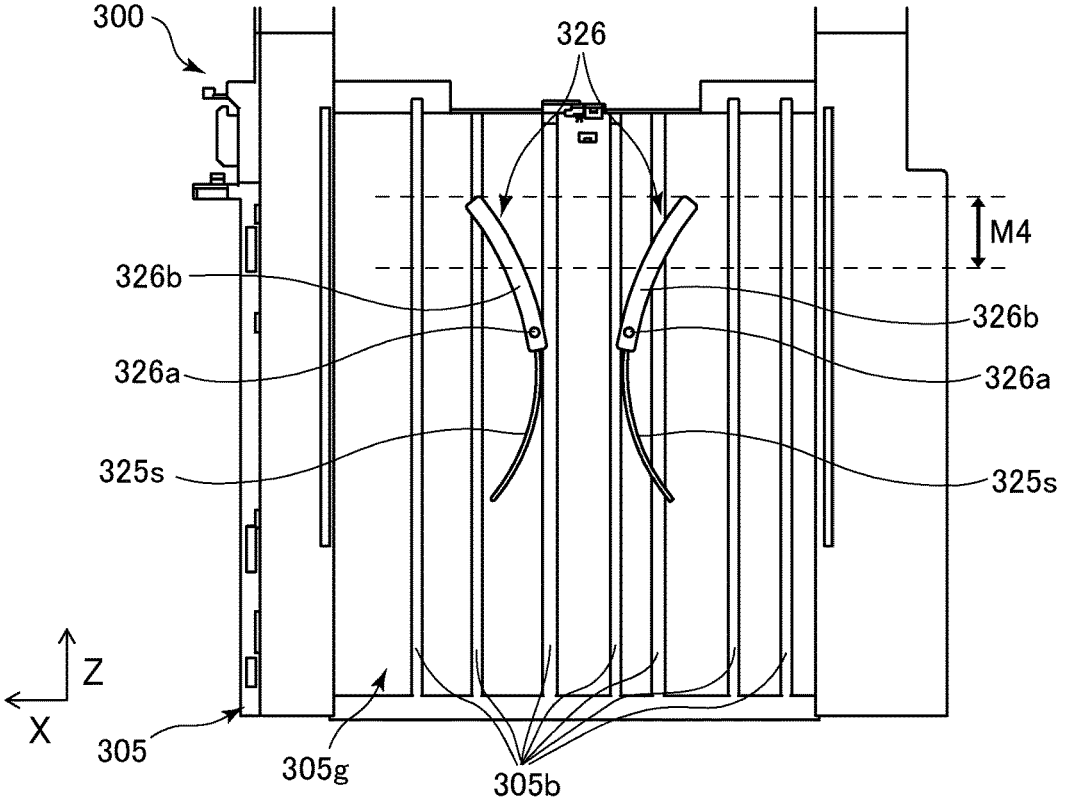
FIGS. 9A and 9B are diagrams illustrating a part of a sheet discharge portion according to a third embodiment.
Figure 9B:
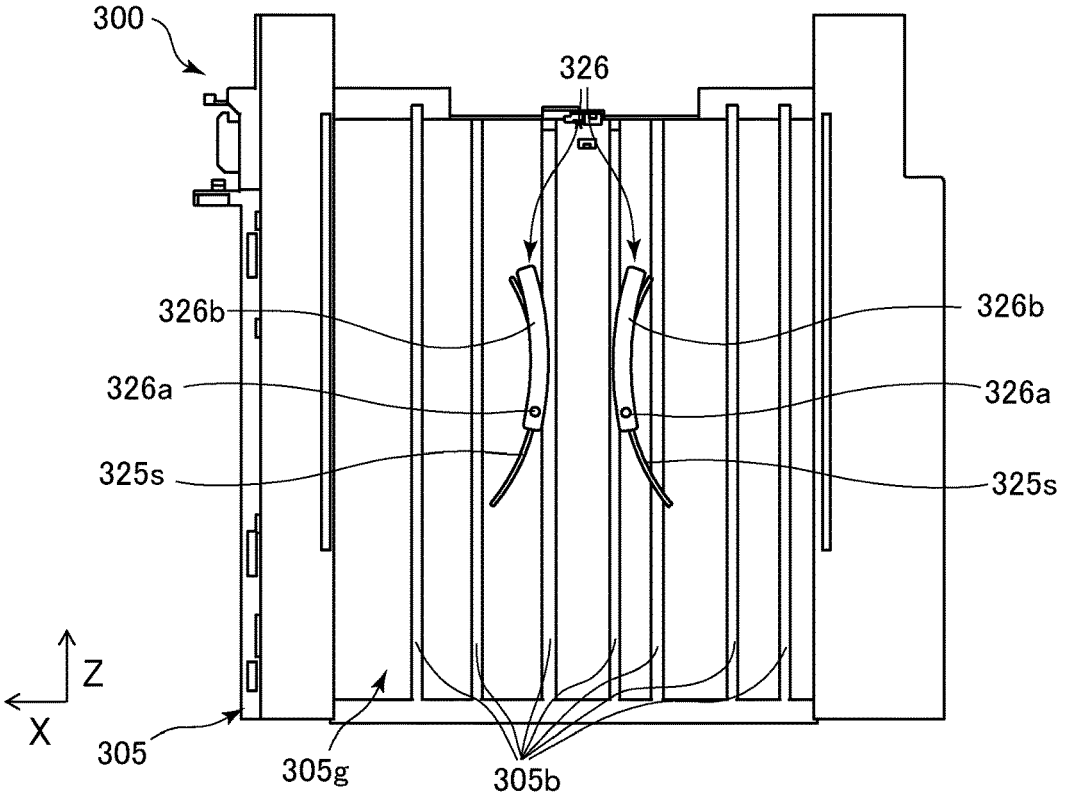

FIGS. 9A and 9B each illustrate the discharge portion 300 in which the tray 302 is detached as viewed from one side in the Y direction, that is, from the downstream side in the sheet discharge direction D. The discharge portion 300 includes the side wall 305 including the stacking wall 305*g* serving as a first abutting portion or a first abutting member, and slide walls 326 serving as second abutting portions or second abutting members.

Two slide walls 326 are provided at positions symmetrical to each other with respect to the center position of the discharge portion 300 in the X direction. The slide walls 326 each include a contact portion 326*b* that comes into contact with the trailing end of sheets stacked on the tray 302, a pressed portion 326*a* pressed by the pressing portion 302*a* of the tray 302 illustrated in FIG. 3A, and an abutting surface that abuts the abutted portion 305*a* of the stacking wall 305*g* illustrated in FIG. 3A. The contact portions 326*b* project further toward the first side in the Y direction, that is, toward the downstream side in the sheet discharge direction D, than the ribs 305*b* of the stacking wall 305*g*. In addition, the slide walls 326 are each capable of sliding along a predetermined trajectory along a guide groove 325*s* provided in the stacking wall 305*g*.

Here, the guide grooves 325*s* serving as second guide portions each extend in a curved shape as viewed from the downstream side in the sheet discharge direction D. In the illustrated example, the guide grooves 325*s* are defined as arcs extending in the up-down direction as viewed from the downstream side in the sheet discharge direction D. The slide walls 326 are each engaged with the guide groove 325*s* in at least two positions in the longitudinal direction of the guide groove 325*s*. Therefore, the slide walls 326 are supported by the stacking wall 305*g* in a slidable state in sliding directions along the longitudinal directions of the guide grooves 325*s* extending in curved shapes. In addition, the slide walls 326 are each urged upward by an urging force of a spring force substantially the same as the spring member 307 of the first embodiment illustrated in FIG. 2A.

FIG. 9A illustrates a state in which the slide walls 326 are positioned at initial positions. FIG. 9B illustrates a state in which the slide walls 326 have moved downward from the initial positions in accordance with the lowering of the tray 302. An operation in the case where the tray 302 moves downward from the home position beyond the accompanying movement starting position for the slide walls 326 will be described below.

When the tray 302 is positioned in the home position, the slide walls 326 are positioned in the initial positions thereof by the urging force of the spring members. At this time, the pressing portion 302*a* of the tray 302 is at a position separated upward from the pressed portions 326*a* of the slide walls 326. While the tray 302 is lowered from the home position to the accompanying movement starting position for the slide walls 326, the slide walls 326 are still in the initial positions. At this time, the sheets on the tray 302 rub the contact portions 326*b* of the slide walls 326 and the ribs 305*b* of the stacking wall 305*g*. However, the amount of sheets stacked on the tray 302 is relatively small at this stage, thus the upstream force in the sheet discharge direction D acting on the sheets due to the inclination of the tray 302 is relatively small, and therefore issues such as noises caused by rubbing by the sheets are not likely to occur.

When the tray 302 reaches the accompanying movement starting position for the slide walls 326, the pressing portion 302*a* of the tray 302 abuts the pressed portions 326*a* of the slide walls 326, and thus a state in which the slide walls 326 move in accordance with the lowering of the tray 302 is taken. Then, as illustrated in FIG. 9B, the slide walls 326 move downward from the initial positions in accordance with the lowering of the tray 302.

Here, the height to which the contact portions 326*b* of the slide walls 326 project upward with respect to the supporting surface 302*b* of the tray 302 in a state in which the tray 302 is in the accompanying movement starting position for the slide walls 326 will be referred to as a wall surface height M4 of the slide walls 326. When the tray 302 is lowered in a region below the accompanying movement starting position, the slide walls 326 slide downward in accordance with the tray 302. Therefore, among the sheet bundle supported on the tray 302, the trailing end of sheets at the wall surface height M4 of the slide walls 326 and below are held by the contact portions 326*b* of the slide walls 326, and moves without rubbing the ribs 305*b* of the stacking wall 305*g*. Therefore, the occurrence of noises and damage to the trailing end of the sheets caused by rubbing the ribs 305*b* of the stacking wall 305*g* can be suppressed for sheets up to the wall surface height M4 of the slide walls 326. In addition, although the sheets stacked higher than the wall surface height M4 rub the ribs 305*b* in accordance with the lifting and lowering of the tray 302, since the force by which these sheets abut the ribs 305*b* is relatively small, issues such as noises caused by the rubbing are not likely to occur.

As described above, the occurrence of issues such as noises caused by the rubbing by the sheets derived from the lifting and lowering of the tray 302 can be reduced similarly to the first embodiment also in the case where a configuration in which the movement trajectories of the slide walls 326 are curved is employed.

Other Embodiments

The configurations described above in the first to third embodiments are merely examples. For example, the lengths of the slide walls 306, 316, 317, and 326 serving as second abutting portions, second abutting members, third abutting portions, and third abutting members in the lifting/lowering direction of the tray 302, and the range in which the slide walls move in accordance with the tray 302 may be changed.

In addition, although a configuration in which part of the tray 302 abuts and presses the slide walls downward and thus the slide walls move in accordance with the lifting and lowering of the tray 302 has been described in the embodiments described above, the accompanying movement of the tray 302 and the slide walls may be realized by a different engagement method. For example, providing a mechanism in which the tray 302 and the slide walls are relatively unmovably locked to each other in the lifting/lowering direction of the tray 302 when the tray 302 abuts the slide walls may be considered. Examples of such a locking mechanism include a toggle mechanism and a snap-fit.

In addition, although the slide walls that slide with respect to the stacking wall 305*g* have been described as examples of second abutting portions or second abutting members in the embodiments described above, for example, members that pivot or swing about a pivot shaft may be used as the second abutting portions or second abutting members. In this case, a configuration in which contact portions are provided on outer peripheral portions away from the pivot shaft, and the contact portions move up and down in accordance with the lifting and lowering of the tray 302 is employed.

Although a sheet stacking apparatus or a sheet discharge apparatus provided in a sheet processing apparatus constituting a part of an image forming system has been described in the embodiments described above, the present technique is applicable to a sheet stacking apparatus or a sheet discharge apparatus in a different apparatus that handles a sheet. Examples of this include a sheet stacking apparatus or a sheet discharge apparatus onto which sheets subjected to image formation are discharged and stacked from an image forming apparatus body in an image forming system not including a sheet processing apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-066671, filed on Apr. 2, 2020, which is hereby incorporated by reference herein in its entirety.

What is claimed is:

1. A sheet stacking apparatus comprising:

a discharge unit configured to discharge a sheet;

a stacking portion on which sheets discharged by the discharge unit are stacked;

a lifting unit configured to lift and lower the stacking portion;

a first abutting portion configured to abut a trailing end of the sheets stacked on the stacking portion in a sheet discharge direction of the discharge unit, wherein the first abutting portion is configured not to move in an up-down direction; and a second abutting portion configured to abut the trailing end of the sheets stacked on the stacking portion, wherein the first abutting portion supports the second abutting portion such that the second abutting portion is movable in the up-down direction, wherein, in a case where the stacking portion is lowered from a first position to a second position below the first position, the second abutting portion is configured not to move in accordance with the stacking portion, and wherein, in a case where the stacking portion is further lowered beyond the second position, the second abutting portion is configured to move in accordance with the stacking portion.

2. The sheet stacking apparatus according to claim 1, further comprising an urging portion connected to the first abutting portion and the second abutting portion and configured to urge the second abutting portion upward.

3. The sheet stacking apparatus according to claim 2, wherein the urging portion includes a spring member whose first end portion is connected to a first connecting portion of the first abutting portion and whose second end portion is connected to a second connecting portion of the second abutting portion, and wherein the second connecting portion is provided below the first connecting portion.

4. The sheet stacking apparatus according to claim 2, wherein the discharge unit is configured to discharge a sheet conveyed through a conveyance path in an apparatus body to outside of the apparatus body, wherein the first abutting portion is part of a side wall of the apparatus body on a downstream side in the sheet discharge direction, and wherein the urging portion is disposed inside the apparatus body with respect to the side wall.

5. The sheet stacking apparatus according to claim 2, further comprising a positioning portion configured to position the second abutting portion, wherein, in a case where the stacking portion is positioned above the second position, the second abutting portion is positioned at a predetermined position by abutting the positioning portion, and wherein, in a case where the stacking portion is positioned below the second position, the second abutting portion moves in accordance with the stacking portion in a region below the predetermined position in a state in which an engaging portion provided in the stacking portion is engaged with an engaged portion provided in the second abutting portion.

6. The sheet stacking apparatus according to claim 5, wherein the engaged portion is a protrusion protruding in a direction intersecting with a lifting/lowering direction of the stacking portion, and wherein the engaging portion is configured to abut an upper surface of the protrusion and press the second abutting portion downward in accordance with lowering of the stacking portion.

7. The sheet stacking apparatus according to claim 1, wherein the discharge unit is configured to discharge the sheet conveyed through a conveyance path in an apparatus body to outside of the apparatus body, and wherein the first abutting portion is part of a side wall of the apparatus body on a downstream side in the sheet discharge direction.

8. The sheet stacking apparatus according to claim 7, wherein the first abutting portion includes a rib provided on the side wall at a position different from the second abutting portion in a sheet width direction intersecting with a lifting/lowering direction of the stacking portion and with the sheet discharge direction, and wherein the rib projecting downstream in the sheet discharge direction and extending along the lifting/lowering direction of the stacking portion.

9. The sheet stacking apparatus according to claim 7, wherein a guide groove configured to guide the second abutting portion such that the second abutting portion moves up and down along a predetermined trajectory as viewed from the downstream side in the sheet discharge direction is provided in the side wall.

10. The sheet stacking apparatus according to claim 9, wherein the guide groove linearly extends in the up-down direction as viewed from the downstream side in the sheet discharge direction.

11. The sheet stacking apparatus according to claim 9, wherein the guide groove extends in a curved shape as viewed from the downstream side in the sheet discharge direction.

12. The sheet stacking apparatus according to claim 1, wherein the first abutting portion includes a first contact surface configured to come into contact with the trailing end of the sheets, wherein the second abutting portion includes a second contact surface configured to come into contact with the trailing end of the sheets, and wherein at least part of the second contact surface projects more downstream than the first contact surface in the sheet discharge direction.

13. The sheet stacking apparatus according to claim 1, wherein the second abutting portion includes a plurality of members arranged in a direction intersecting with the sheet discharge direction and with a lifting/lowering direction of the stacking portion and each configured to abut the trailing end of the sheets.

14. The sheet stacking apparatus according to claim 1, further comprising a third abutting portion configured to come into contact with the trailing end of the sheets stacked on the stacking portion, wherein the first abutting portion supports the third abutting portion such that the third abutting portion is capable of moving up and down independently of the second abutting portion, wherein, in a case where the stacking portion is lowered from the first position to a third position below the second position, the third abutting portion is configured not to move in accordance with the stacking portion, wherein, in a case where the stacking portion is further lowered beyond the third position, the third abutting portion is configured to move in accordance with the stacking portion, and wherein the third abutting portion is configured to contact the trailing end of the sheets in a region above the second abutting portion in a state in which the stacking portion is at the third position.

15. The sheet stacking apparatus according to claim 14, wherein the second abutting portion includes a second contact surface configured to come into contact with the trailing end of the sheets, wherein the third abutting portion includes a third contact surface configured to come into contact with the trailing end of the sheets, and wherein at least part of the second contact surface projects more downstream than the third contact surface in the sheet discharge direction.

16. A sheet processing apparatus comprising:

a processing unit configured to process a sheet; and the sheet stacking apparatus according to claim 1 configured to stack at least the sheet processed by the processing unit or a sheet that is not to be subjected to processing by the processing unit.

17. An image forming system comprising:

an image forming unit configured to form an image on a sheet; and the sheet stacking apparatus according to claim 1 configured to stack the sheet on which an image has been formed by the image forming unit.

* * * * *